US006858123B1

(12) United States Patent
Hu et al.

(10) Patent No.: US 6,858,123 B1
(45) Date of Patent: Feb. 22, 2005

(54) GALVANIZING SOLUTION FOR THE GALVANIC DEPOSITION OF COPPER

(75) Inventors: Jung-Chih Hu, Hsinchu (TW); Wu-Chun Gau, Hsinchu (TW); Ting-Chang Chang, Kaohsiung (TW); Ming-Shiann Feng, Hsinchu (TW); Chun-Lin Cheng, Jung Li Taur-Yuan (TW); You-Shin Lin, Su-Yuh Yi-Lan (TW); Ying-Hao Li, Taoyuan (TW); Lih-Juann Chen, Hsinchu (TW)

(73) Assignee: Merck Patent Gesellschaft MIT Beschrankter Haftung, Darmstadt (DE)

( * ) Notice: Subject to any disclaimer, the term of this patent is extended or adjusted under 35 U.S.C. 154(b) by 0 days.

(21) Appl. No.: 10/070,000

(22) PCT Filed: Aug. 25, 2000

(86) PCT No.: PCT/EP00/08312

§ 371 (c)(1),
(2), (4) Date: Nov. 27, 2002

(87) PCT Pub. No.: WO01/16403

PCT Pub. Date: Mar. 8, 2001

(30) Foreign Application Priority Data

Sep. 1, 1999 (DE) ..... 199 41 605

(51) Int. Cl.[7] ..... C25D 3/38; C23C 18/00
(52) U.S. Cl. ..... 205/291; 106/1.26
(58) Field of Search ..... 205/291; 106/1.26

(56) References Cited

U.S. PATENT DOCUMENTS

| | | | | |
|---|---|---|---|---|
| 4,746,411 A | | 5/1988 | Klos et al. | |
| 5,051,154 A | | 9/1991 | Bernards et al. | |
| 5,174,886 A | * | 12/1992 | King et al. | 205/125 |

FOREIGN PATENT DOCUMENTS

| | | |
|---|---|---|
| DE | 36 19 385 A | 12/1987 |
| GB | 2 266 894 A | 11/1993 |
| JP | 57 057882 A | 4/1982 |

OTHER PUBLICATIONS

Mizumoto et al., "Determination of Formaldehyde on Electroless Copper Plating Solution by Potentiometric Titration", Hyomen Gijutsu (1990), vol. 41, No. 4, pp. 412–416. Abstract only.*

James J. Kelly, "Copper Deposition in the Presence of Polyethylene Glycol," *Journal of the Electrochemical Society*, Electrochemical Society, Manchester, New Hampshire, US, vol. 145, No. 10, Oct. 30, 1998, pp. 3472–3476, XP002148319.

* cited by examiner

*Primary Examiner*—Edna Wong
(74) *Attorney, Agent, or Firm*—Millen White Zelano & Branigan P.C.

(57) ABSTRACT

The invention relates to a novel galvanizing solution for the galvanic deposition of copper. Hydroxylamine sulfate or hydroxylamine hydrochloride are utilized as addition reagents and added to the galvanizing solution during the galvanic deposition of copper which is used in the manufacture of semiconductors.

8 Claims, 32 Drawing Sheets

1.2 A/dm²

3.2 A/dm²

▲ without additive agent

Figure 1:
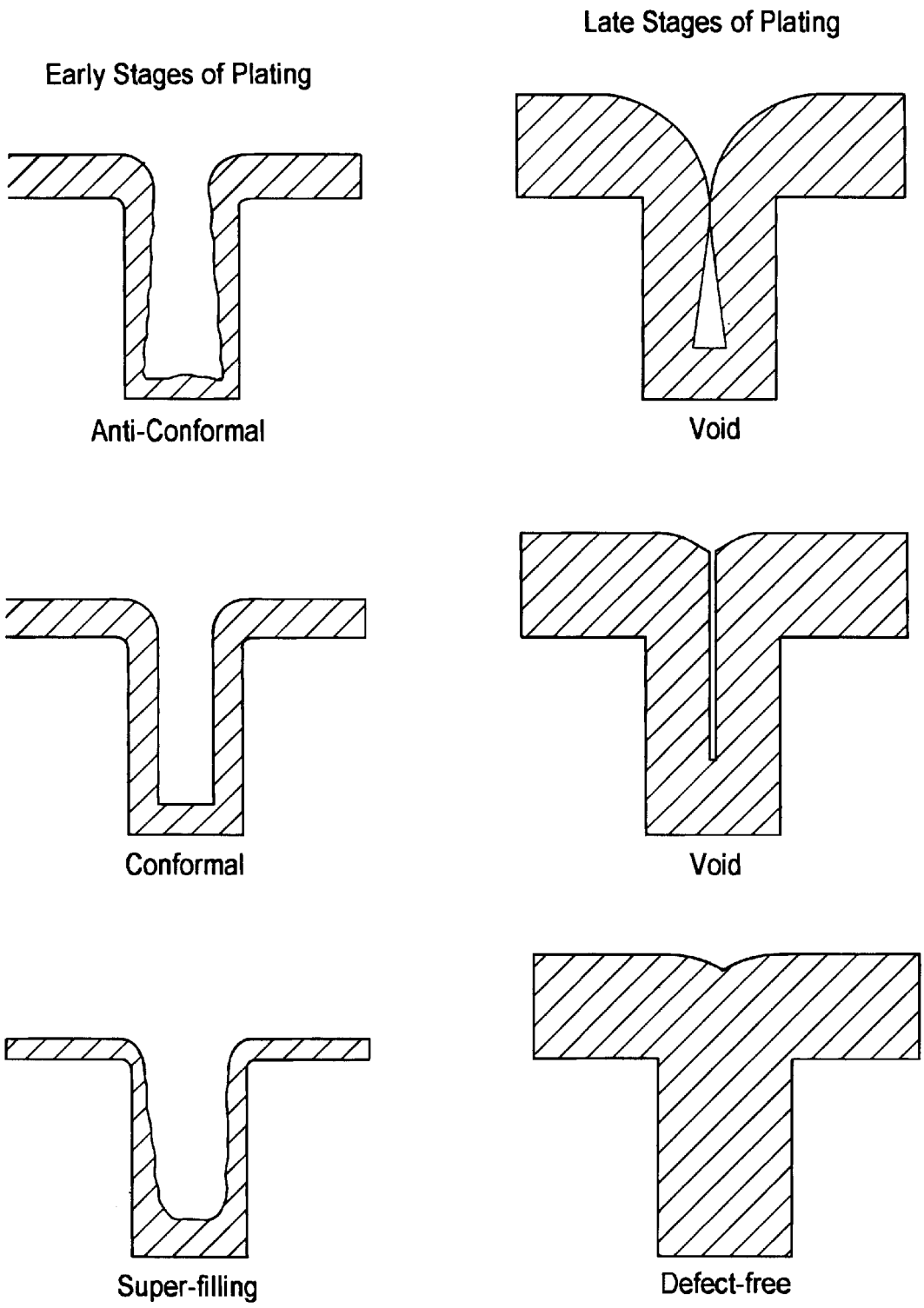
Fig. 1 PRIOR ART

△ 0,0036 g/L $(NH_2)_2$ CS and PEG200

× 0,0036 g/L $(NH_2)_2$ CS and PEG1000

○ 0,0036 g/L $(NH_2)_2$ CS and PEG4000

▲ S.T.D.

△ $(NH_2)_2$ CS + PEG200

× $(NH_2)_2$ CS + PEG1000

○ $(NH_2)_2$ CS + PEG4000

▲ without additive agent

△ with $(NH_2OH)_2{}^*H_2SO_4$

× with $NH_2OH^*HCl$

GALVANIZING SOLUTION FOR THE GALVANIC DEPOSITION OF COPPER

This application is a 371 National Stage Application of PCT/EP/00/08312 filed Aug. 25, 2000.

The present invention concerns to a novel electroplating solution for copper electroplating. Hydroxyl amine sulfate or hydroxyl amine hydrochloride are used as additive agents and added into the electroplating solution used in copper electroplating process of semiconductor manufacturing.

Low resistivity and expected good reliability of copper make it an obvious choice used for long and narrow interconnections. However, processing difficulties associated with Cu still need to be overcome before the introduction of Cu metallization. In addition, a commercially maturized equipment still needs to be developed in order to bring Cu metallization into production.

Via and trench will be filled copper by plating (also called electrochemical deposition). However, a major drawback of electroless copper deposition process is low plating rate. Other shortcomings, e.q. contamination, healthy, complex compounds, hard to control its composition are also to be considered. Electroplating is an attractive alternative for copper deposition, since it is not available for tungsten or aluminum. Electroplating is a very inexpensive process compared to vacuum fabrication and electroless deposition. A number of research groups have developed electroplating to use in damascene structures. A potential disadvantage of electroplating is that it is a two-step process. PVD or CVD method can be competed in one step (directly on top of the diffusion-barrier), while electroplating requires deposition of a thin seed-layer prior to the plating fill step. The seed-layer provides a low-resistance conductor for the plating current that drives the process, and also facilitates film nucleation. If seed layer is not perfect (i.e., continuous), it can create a void during copper filling.

Copper is the most favorable material used for seed layer because of its high conductivity, and because it is an ideal nucleation layer with high conductivity. Copper seed layer plays two critical roles during electroplating. On the wafer scale, seed layer carries current from the edge of the wafer to the center, allowing plating current source to contact the wafer only near the edge. The thickness of seed layer must be sufficient large so that voltage drops from wafer edge to center does not reduce electroplating uniformity. On a localized region, seed layer carries current from the top surface to the bottom of vias and trenches. When there is insufficient seed-layer thickness at the bottom, a void is formed at the center of via or trench during deposition. In order to produce a uniform and good adhesion film of electroplated copper, a seed layer must be deposited perfectly over the barrier layer.

In principle, the thickness of the seed layer at the bottom (in a high aspect ratio feature) can be increased by increasing the thickness of copper that deposited on the field. However, an excess of seed material deposited at the field level will pinch off the via or trench, creating a center void in the film. Although PVD copper has poor step coverage in a high-aspect-ratio of vias and trenches, it has been successfully applied to Cu electroplating. PVD copper used for seed layer is successful at the narrowest feature of 0.3 $\mu$m. At the dimension below 0.3 $\mu$m, PVD copper seed layer can be deposited using ionized PVD methods. In addition, a CVD seed layer will probably be used for next generations.

Copper CVD is good alternative used for seed-layer primarily because it has nearly 100% step coverage. A superior step-coverage of the CVD copper process requires no additional cost relative to the PVD process. CVD copper seed-layer process can be used to fill narrow via completely in a single-damascene application, which is a significant process in future technique.

Although electroplating is a two-step process, calculations indicate that it offers a lower overall cost-of-ownership (COO) compared to CVD. The COO calculation includes the cost of the deposition equipment, fabrication space and consumables, but neglects device or process yield. The major difference is mainly due to lower capital and chemical costs of the electroplating process. Most importantly, a well-tuned electroplating process can fill a high-aspect-ratio structures.

(III) Enhanced Gap Filing Capability in Electroplating

The big challenge in Damascene plating is to fill vias/trenches without void or seam formations. FIG. 1 presents possible evolution of plated copper. In conformal plating, a deposit of equal thickness at every point of a certain dimension leads to the creation of a seam, or voids form because of different deposition rate. Sub-normal plating leads to the formation of a void even in straight-walled features. Sub-conformal plating is resulted from substantial depletion of the cupric ion in the plating solution inside the feature, which produces significant concentration overpotentials to cause the current to flow preferentially to more accessible locations outside the feature. In order to get defect-free filling, an increasing deposition rate along the sides and the bottom of the feature is desired. As early as 1990 at IBM, they discovered certain plating solutions that contain additives could lead to super-conformal formation that eventually produces void-free and seamless structures [FIG. 1]. They call this is "super-filling".

In generally, the electroplating rate is a direct function of current density. If one has a high density at the top of a structure (or at the top sharp edges) and a lower density at the bottoms one gets a different plating rate. Voids form because there is faster plating on the top sharp edges of trenches compared to on the bottoms. Two methods to enhance deposition uniformity and gap filling capability in electroplating process are physical and chemical approaches.

Physical method is to apply a pulsed plating (PP) or periodic pulse reverse (PPR) with both positive and negative pulses (etc., a waveform to the cathode/anode system). Periodic pulsed plating (PPR) techniques could reduce the formation of voids because the rate of metal deposition inside a trench is nearly the same as the rate at the upper portion. It is virtually like a deposition/etching sequence. It can produce a deposition/etching sequence that polish copper in the high-density regions more quickly than in the low-density regions, and produce the required gap fill capability. Pulsed plating (PR) can decrease the effective mass transfer boundary layer thickness and thus produce higher instantaneous plating current density as well as better copper distribution. Decreasing thickness of boundary layer could lead to significant concentration overpotentials decreased. Therefore, the filling capability could be enhanced in a high aspect ratio of via/trench.

Chemical method is to add organic additives in the electroplating solution. A widely used electroplating solution consists of many additive groups (e.g. thiourea, acetylthiourea, naphthalene sulfonic acid). However, levelers are chemicals with an amine group (e.g. tribenzylamine). Carrying agents could promote the deposition of ductile copper, while brightener and leveling agents level out non-uniform substrates during electrodeposition. In order to make electrodeposition on a small dimension very well (in very high aspect ratios for future ULSI metallization), an understanding of additive agent is required to further study. Establishing proper agents in a specific action and a proper concentration ratio often determines the success of a gap filling plating process.

Figure 3A:
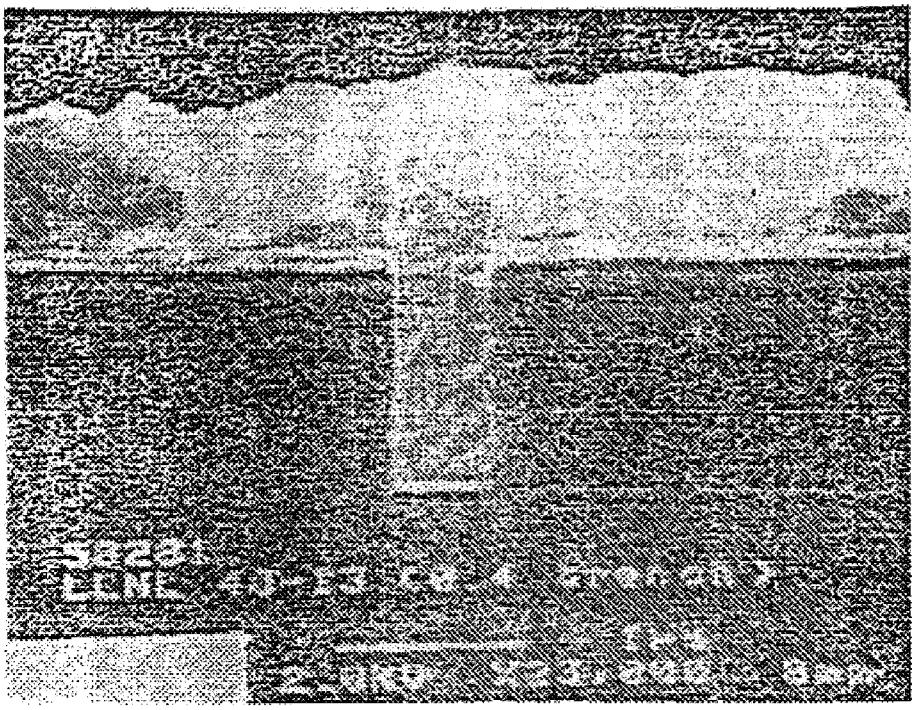
Figure 3B:
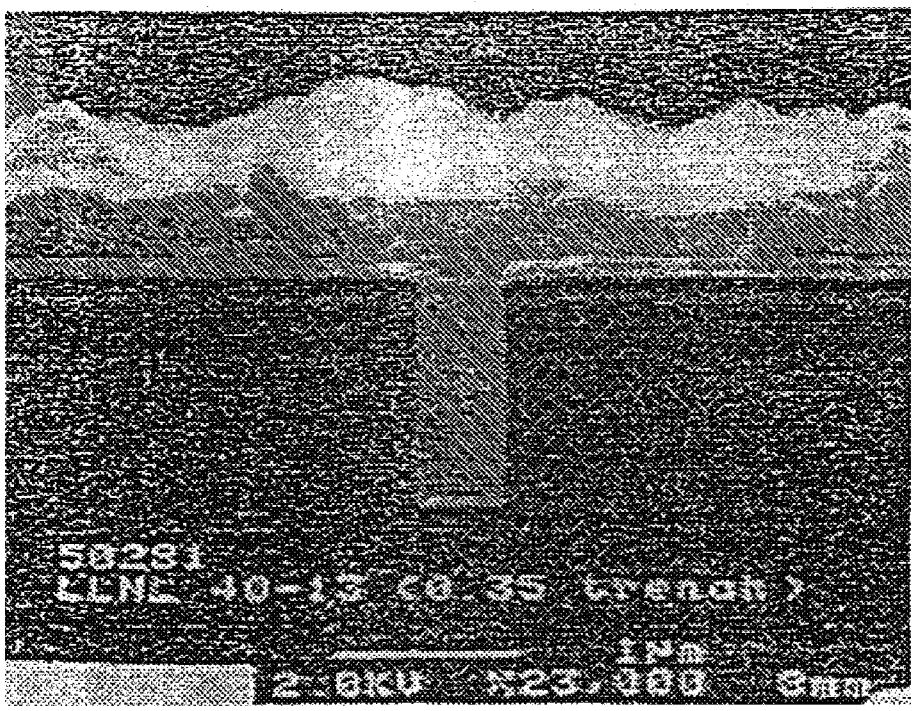

In 1995, Intel corporation utilized a pulsed electroplating technology in a damascene process to produce low resistance copper interconnects with aspect ratios of 2.4:1.[FIGS. 3*a* & 3*b*.] A tantalum barrier layer (about 300–600 A thickness) and a copper seed layer were deposited using collimated PVD. Normally the thickness of the copper seed layer was 1100 A on the top of the substrate, 280 A on the sidewall and 650 A on the bottom of the trench. After electroplating of about 1.5–2.5 $\mu$m of copper at a rate of 500–2000 A/min, the samples were processed by chemical mechanical polishing to remove the field metallization and leave copper in the trenches and vias. The resistivity of electroplated copper was lower than 1.88 $\mu\Omega$·cm. They demonstrated that the filling capability was heavily dependent upon the sputtered copper uniformity in the trenches. If sputtered copper coverage showed a significant closure at the top of the trench, then large voids could be formed after plating. However, if a uniform copper were sputtered in the trenches, then a good copper filling would occur during plating. In addition, an inadequate waveform control could result in severe void under the identical sputtering and plating condition.

In 1998, CuTek Research Inc. developed a new deposition system, which has a standard cluster tool configuration with a fully automatic dry/clean wafer in and dry/clean wafer out operation. Cu electroplating is performed on a Cu seed layer with a thickness of 30–150 nm. A sputtered Ta or TaN with 30 nm thickness is used as a barrier and an adhesion layer, respectively. An excellent gap filling with thicker deposited in the trenches than on top of the field surface could be achieved using pulse plating (PP) and periodic pulse reverses (PPR) with suitable additive agents. Dual damascene structures with 0.4 $\mu$m feature size in an aspect-ratio of 5:1 and deep contact structures with 0.25 $\mu$m feature size in an aspect-ratio of 8:1 could be completely filled without any void or seam function. The impurity contained in electroplated Cu film is measured to be below 50 ppm. The major contaminants found were H, S, Cl, and C. A higher concentration of these elements is measured at the edge of wafer in comparison with the center. This is probably due to high hydrogen evolution and higher organic additive incorporated at the high current density region.

In 1998, UMC (Uited Miroelectronics Corporation) has demonstrated the integration of copper process by using a simple and cost-effective dual damascene architecture. The metal-filling process for Cu interconnection includes (1) a deposition of 400 A ionized-metal-plasma (IMP) Ta or TaN which serves as barrier to prevent Cu diffusion and as an adhesion promoter of Cu to oxide IMD layer, (2) a PVD Cu seed layer, and (3) a Cu electroplating. An excess of Cu over oxide is removed by using chemical-mechanical polish (CMP) technique. The optimized metal deposition process is able to fill a high aspect-ratio (~5) of a 0.28 $\mu$m feature hole without seams formation.[FIG. 4]

(VI) EXPERIMENT

[A] Basic

Two major components in the electroplating process are compositions of the electroplating solution and the method in which the current applied. In section (I), we have discussed how to select the method of current applied and the composition of electroplating solution. In addition, it is noticed that the electrolytic production of copper in copper deposition and the control of the cathode growth are very important. The reason is important because cathode growth is affected by many factors: (a) the quality of anode, (b) the electrolyte composition and impurities, (c) the current density. (d) The surface condition of the starter cathode, (e) the geometric anode and cathode (f) the uniformity of spacing (agitation) and the distance between electrodes and (g) the temperature or current density.

Electroplating can be carried out at a constant current, a constant voltage, or at variable waveforms of current or voltage. In our experiment, a constant current with accurate control of the mass of deposited metal is most easily obtained. Plating at a constant voltage with viable waveforms requires more complex equipment and control. The temperature of electroplating solution in experiment process is constant (at R.T). Therefore, we can neglect the influence of temperature on deposition rate and film quality.

[B] Prepare Substrate and Experimental Process

P-type (001) oriented single crystal silicon wafers of 15–25 Ω-cm in 6-inch diameter were used as deposition substrates in this work. The blank wafers were first cleaned by a conventional wet cleaning process. After wet cleaning, wafers were treated with a dilute 1:50 HF solution before loading into a deposition chamber. A 50-nm-thickness of TIN and a 50-nm-thickness of Cu were deposited using conventional PVD to act as a diffusion barrier and a seed layer, respectively. Patterned wafers were fabricated to examine the ability of Cu electroplating in small trenches and vias. After standard RCA cleaning, wafers were treated with thermal oxidation. Then, a photolithography technique with reactive ion etching (RIE) was used to define a definite dimension of trenches/vias. A 40-nm-thickness of TaN used as barrier and a 150-nm-thickness of Cu used as a seed layer were deposited by ionized metal plasma (IMP) PVD, respectively. The dimension of trench/via was defined between 0.3–0.8 $\mu$m. An electroplating solution, which was used for Cu electroplating, was usually composed of $CuSO_4.5H_2O$, $H_2SO_4$, Cl, additives, and wetting agent. The compositions of the electroplating solution were described in Table 2. Additives were frequently added in Cu electroplating because they worked as brightening, hardening, grain refining, and leveling agents. The current density applied was 0.1–4 A/dm$^2$. Besides, Cu(P) (Cu: 99.95%, P: 0.05%) material was used as an anode to supply sufficient Cu ions and made good quality of Cu electroplated films.

[C] Equipment of Electroplating

Figure 5:
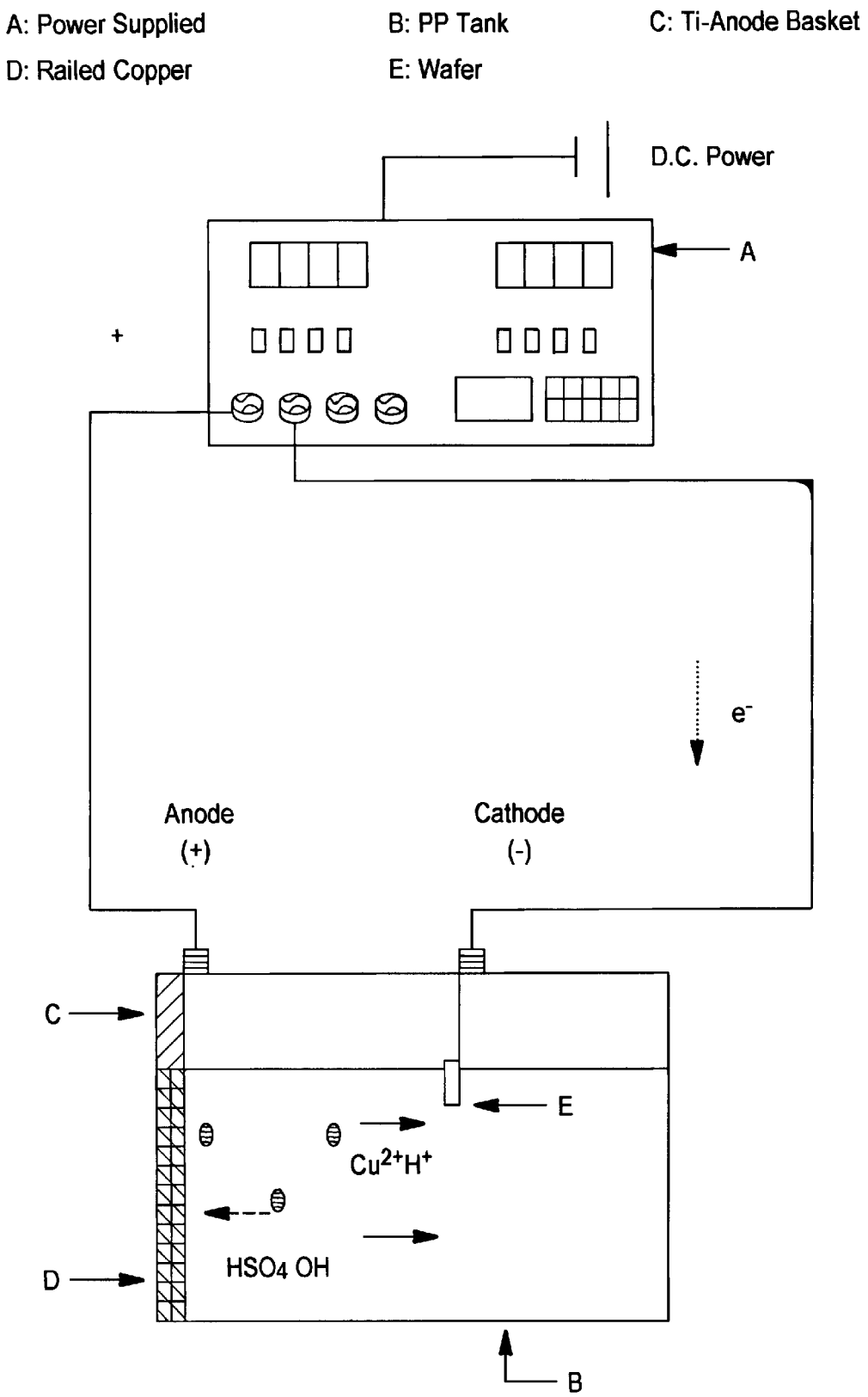

The simple electroplating system was described as followed: [FIG. 5]

(a) Wafer: P-type (001) oriented single crystal silicon wafers of 15–25 Ω-cm 6'-inch diameter (b) Power Supplier: GW1860 (固偉)

(c) PP Tank: 20 cm×19 cm×20.5 cm (d) Rolled Copper (Cu: 99.95%, P: 0.05%): 30 piece
Produced by Meltex Learonal Japan company (e) Titanium anode basket: 20 cm×19 cm×2 cm

[D] Analysis Tool (a) Field Emission Scanning Electron Micrscopy (FESEM): HITACHI S-400

The morphology and step coverage we examined by using field emission scanning electron microscope (FESEM).

(b) Sheet Resistance Measurement

The resistivity of electroplated Cu film was measured by a four-point probe. The sheet resistance of the Cu films were determined using a standard equal-spaced four point probe. The spacing between equal-spaced four point probes was 1.016 mm. Current was passed through the outer two probes and the potential across the inner two probes was measured. The applied current was from 0.1 to 0.5 mA.

(c) X-Ray Power Diffractometer (XRPD): MAC Sience, MXP18

X-Ray diffractometer (XRD) was utilized to investigate crystal orientation of Cu electroplated films. X-ray analysis was performed in a Shimadzu diffractometer and employed with Cu K $\alpha$ radiation ($\lambda$=1.542 A) in conventional reflection geometry and scintillation counter detection.

(d) Auger Electron Spectrocope (AES): FISONS Microlab 310F

Auger electron spectroscope (AES) was applied to determine the stoichiometry and uniformity along the depth direction.

(e) Secondary Ion Mass Spectrometry (SIMS); Camera IMS-4f

SIMS (Secondary Ion Mass Spectrometry) was utilized to do the contamination analysis.

(VII) Results and Discussions

[A] The Effect of Applied Current and Concentration

Figure 6:
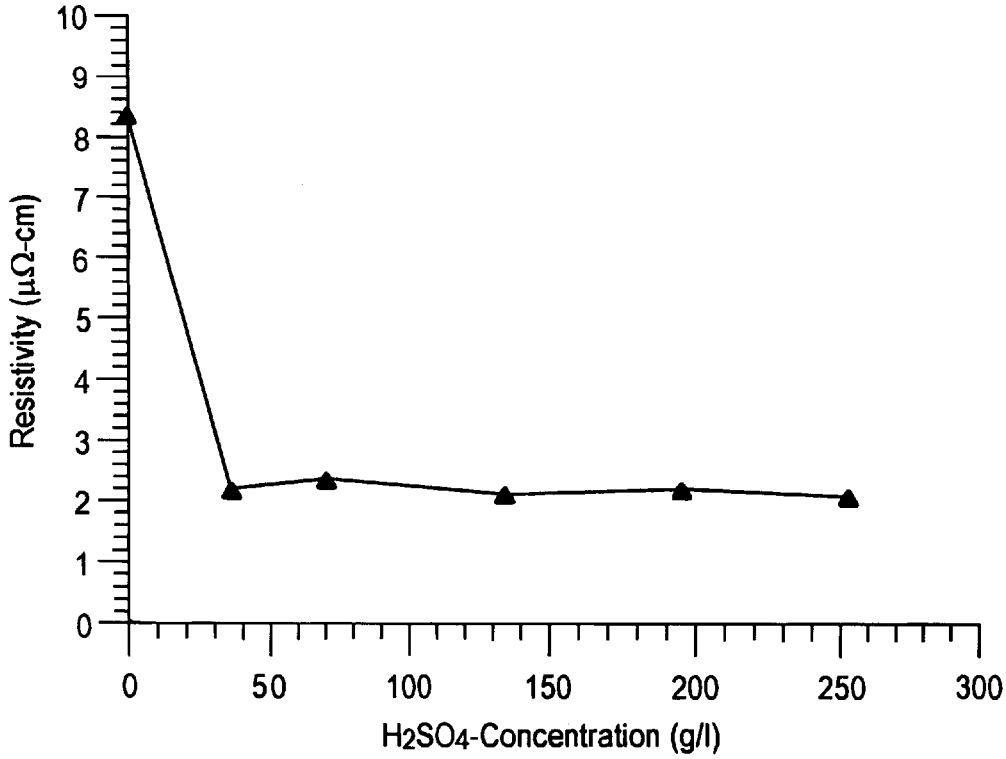
Figure 7:
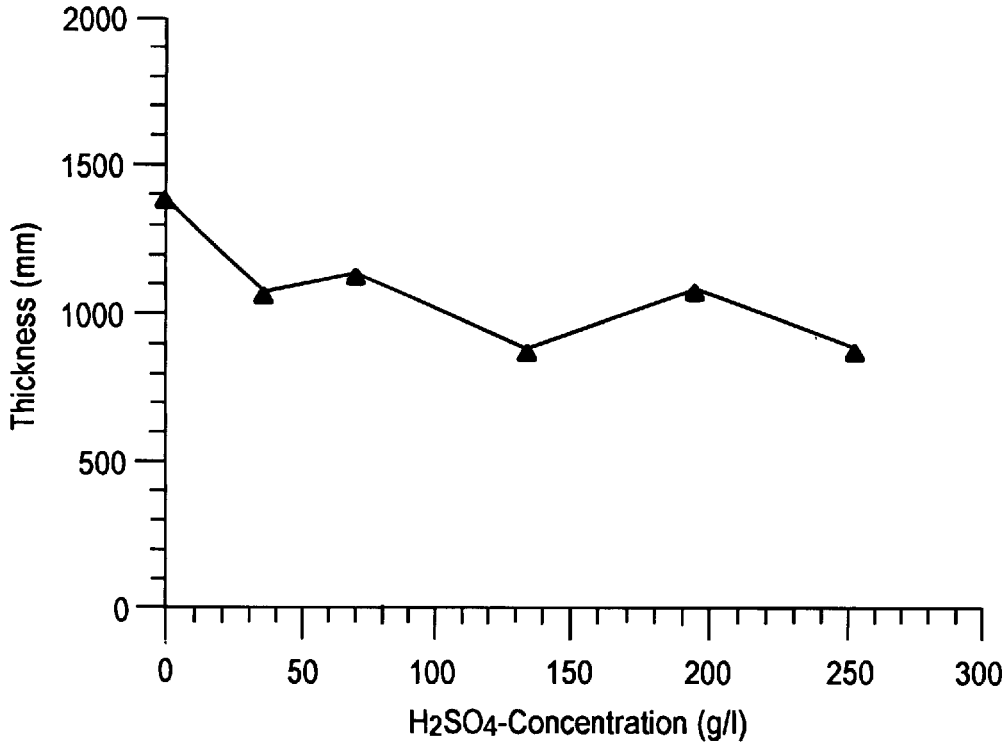

In our study, we first change the concentration of sulfate acid and keep concentration of copper sulfate at constant. FIG. 6 shows the concentration change of sulfate acid vs. thickness variation. We can find no obvious change in thickness when increasing the concentration of sulfate acid. FIG. 7 presents the relationship between film resistivity and concentration of $H_2SO_4$. The resistivity is constant when concentration is increasing. In FIGS. 8(*a*) & 8(*b*), SEM images show film morphology with and without $H_2SO_4$ presence. We can find the uniformity and roughness of copper film is smoother when the sulfate acid in present and makes the resistivity of copper film lower. In our opinion, the purpose of sulfuric acid is to prevent anode polarization and to improve conductivity of the electrolyte and cathode film, but does not very strong affect on the deposited copper film.

Figure 9:
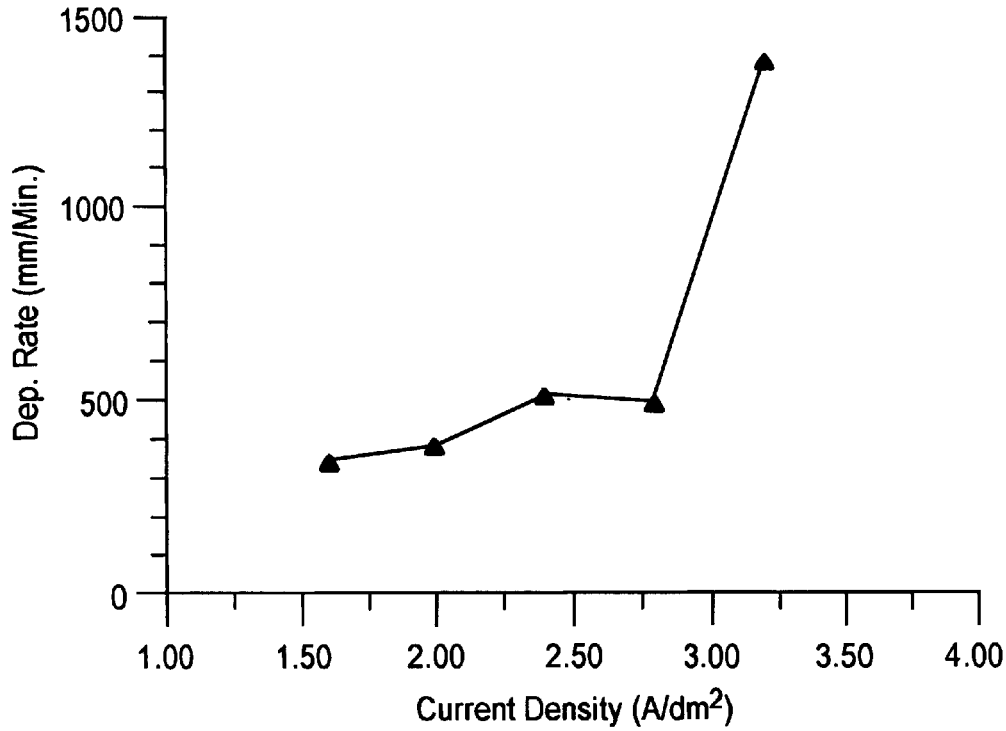
Figure 10:
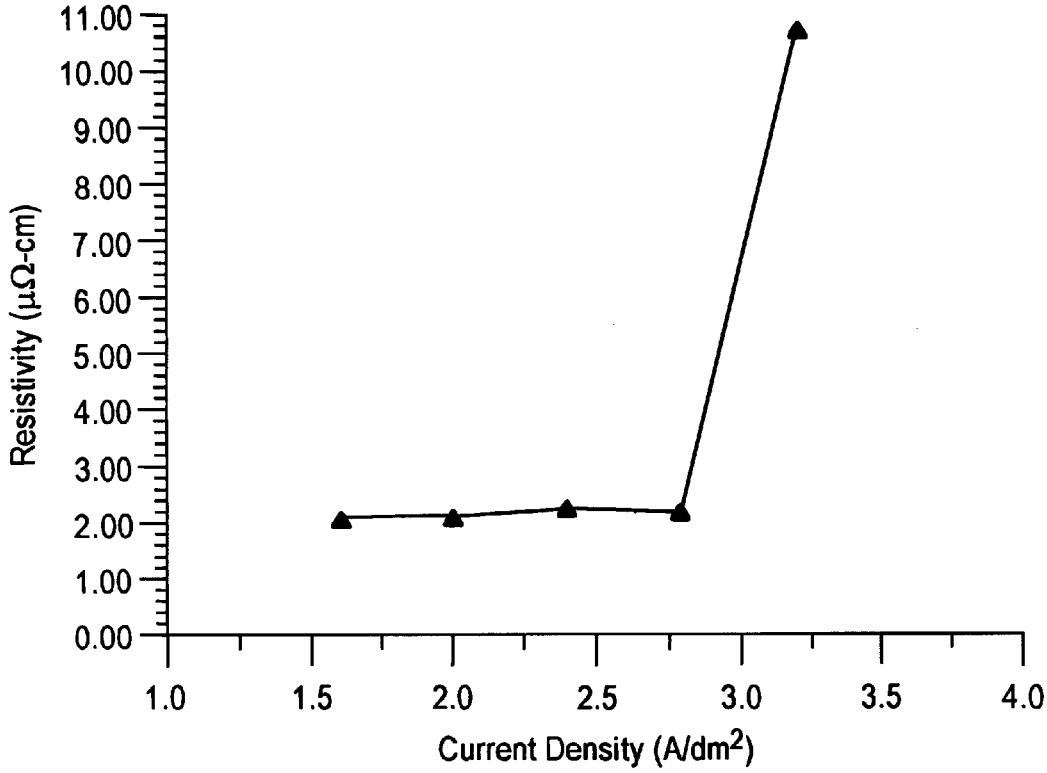
Figure 12:
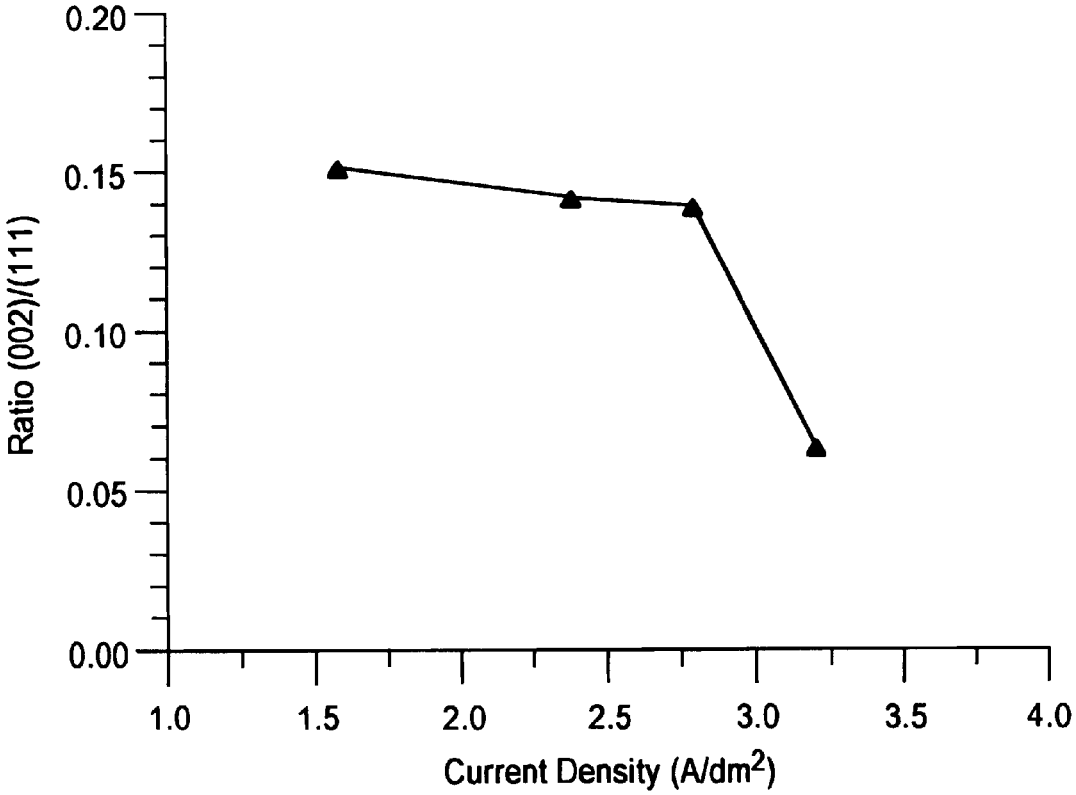
Figure 13A:
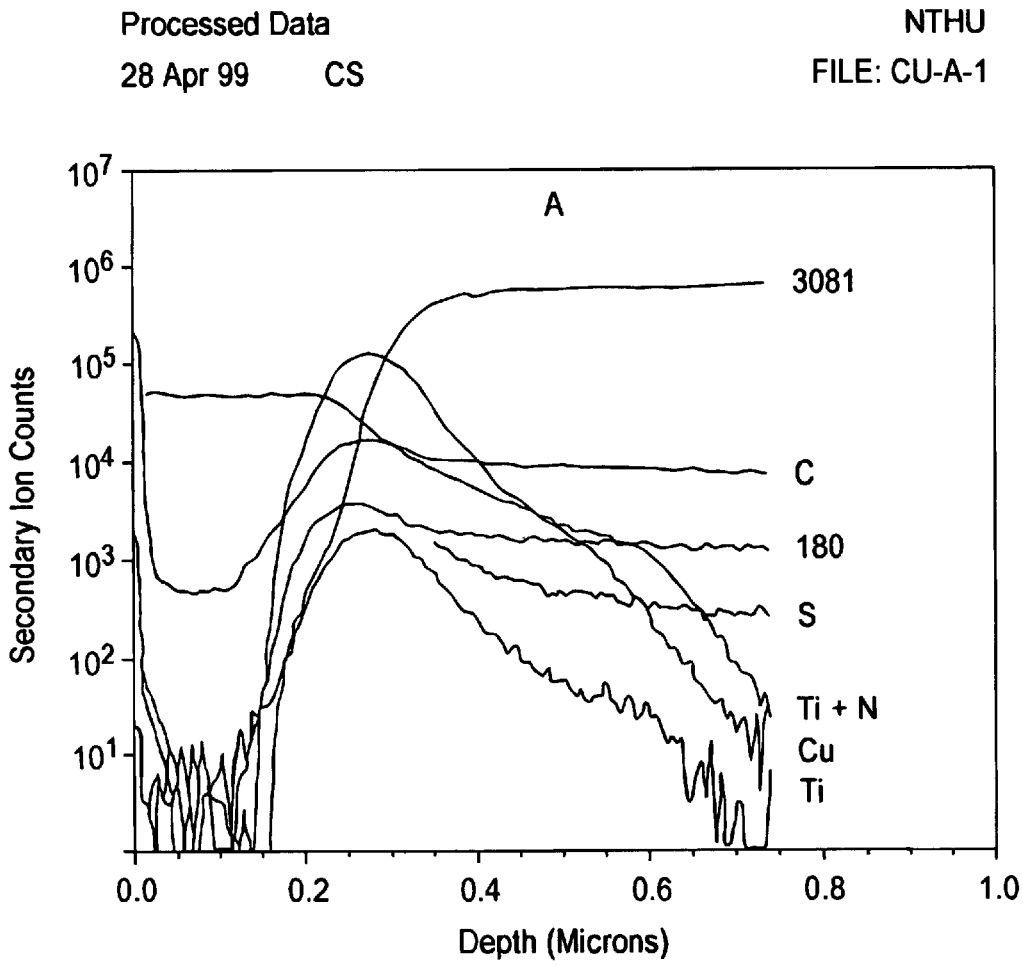

In experiment, we keep concentrations of sulfate acid (=197 g/l) and sulfate copper (90 g/l) constant. Since conductivity of solutions is higher, and anode and cathode polarization are small, voltage required for Cu deposition is small. Change in sulfate acid concentration has more influence than changes in copper sulfate concentration in solution conductivity and anode and cathode polarization. FIG. 9 shows the relation between applied current change and Cu deposition rates. It is found that deposition rate increases with increasing applied current. The deposition rate reaches a maximum when applied current increases to 3.2 A/dm$^2$. As shown in FIG. 10, we can see the resistivity changes with different applied current. When applied current is at 3.2 A/dm$^2$, the resistivity becomes very large. FIGS. 11(*a*) and 11(*b*) present film morphology of Cu electroplated on seed layer/TiN/Si at various current densities (1–4 A/dm$^2$) without additive addition. Large grain of Cu film is observed at high current density. The resistivity exhibits unusually high (~10 $\mu$m-cm) when high current is applied. A high resistivity of Cu film observed could be attributed to rough surface formation, which resulted in film non-conformity at high current condition. The rough surface formed at high current could be rationalized by following postulations. It was supposed that Cu electroplating rate depended on Cu ions diffusion onto a substrate surface. At high current applied, most of Cu ions were effected at a high electric field; therefore, Cu ions diffusion from solution to substrate surface was very fast. Since Cu ion diffusions was very fast, the depletion of Cu ions in diffusion layer was very rapid; Cu ions could not be supplied instantly from electroplated solution into a diffusion layer. The Cu electroplating was limited by Cu ion diffusion. This was called diffusion controlled. Since no replenish of Cu ions diffused onto substrate surface, no more of nucleation was formed on the surface. Cu aggregation could occur on the surface due to high electric field effect. A rough surface formed was ascribed to Cu agglomeration. FIG. 12 presents relative intensity ratio of Cu(111)/Cu(002) by X-ray diffraction measurement at various applied current density. According to XRD results, a strong (111) orientation was always observed at higher current density applied. The development of growth orientation of the copper film could be rationalized by considering surface energy and strain energy at different crystal orientations. In the initial stage, the orientation of Cu (002) plane was formed because this plane possessed the lowest surface energy. As applied electrical current was increased, the strain energy becomes a dominant factor in governing grain growth. The peak intensity of Cu (111) was increasing at high electrical current applied because of high strain energy in Cu (111) orientation. In addition, a Cu (111) orientation was preferred because this orientation showed better electromigration resistance. Contradictory, Cu (111) formed at high current density could make a surface rougher as shown in FIG. 16(*b*). In order to improve the filling of Cu electroplating, it was attempted to add some additives in electroplating solution. A high resistivity of Cu film at high current was also analyzed by SIMS and compared with that at low current condition (see FIGS. 13*a* & *b*). The oxygen concentration in the high resistivity of Cu film is higher because of its rough surface with film non-conformity at high current condition.

[B] The Effect of Traditional Additive Agents

Figure 14:
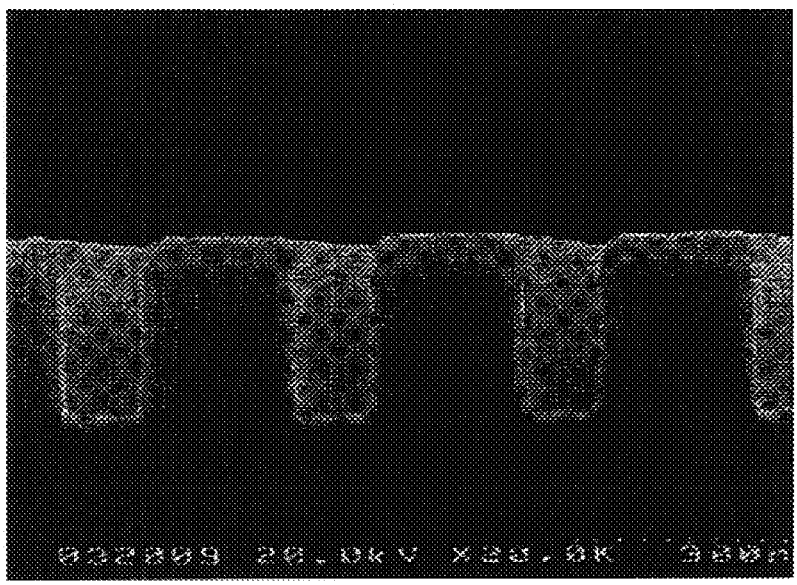
Figure 14:
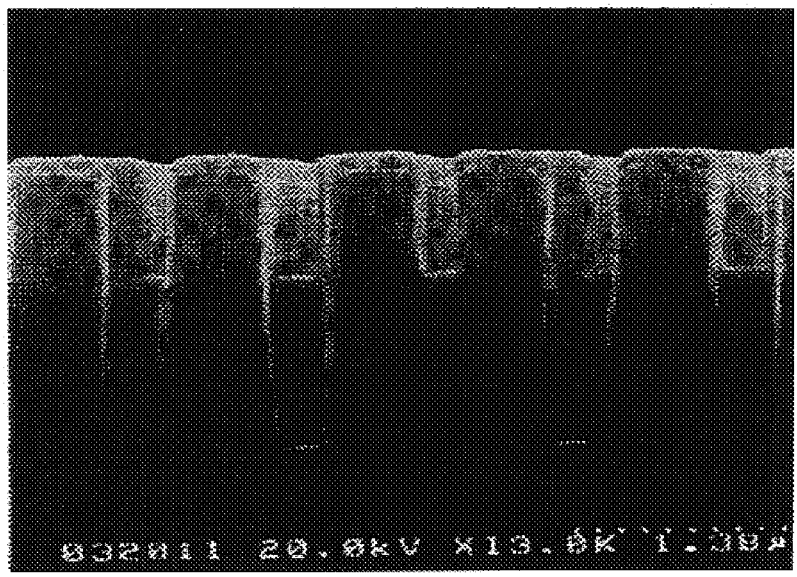

In order to understand the gap filling capability in electroplating processing. Then, the dimension of trench/via was defined between 0.30–0.8 $\mu$m used to test gap filing capability. FIG. 14 shows the images of pattern wafer before electroplating. The thickness of Cu seed layer on the bottom and on the side-wall is less than on the top.

We used HCl as additive agent for electroplating. Addition of HCl does not make any prominent difference in film resistivity and film morphology in blanket wafer.[FIG. 15] As shown from in pattern wafers [see FIGS. 16(*a*) and (*b*)], we find the uniformity at the top of the trench is smoother when the HCl was added in solution. FIG. 17 revealed that voids are formed if no additive agent was added into the solution.

Figure 19:
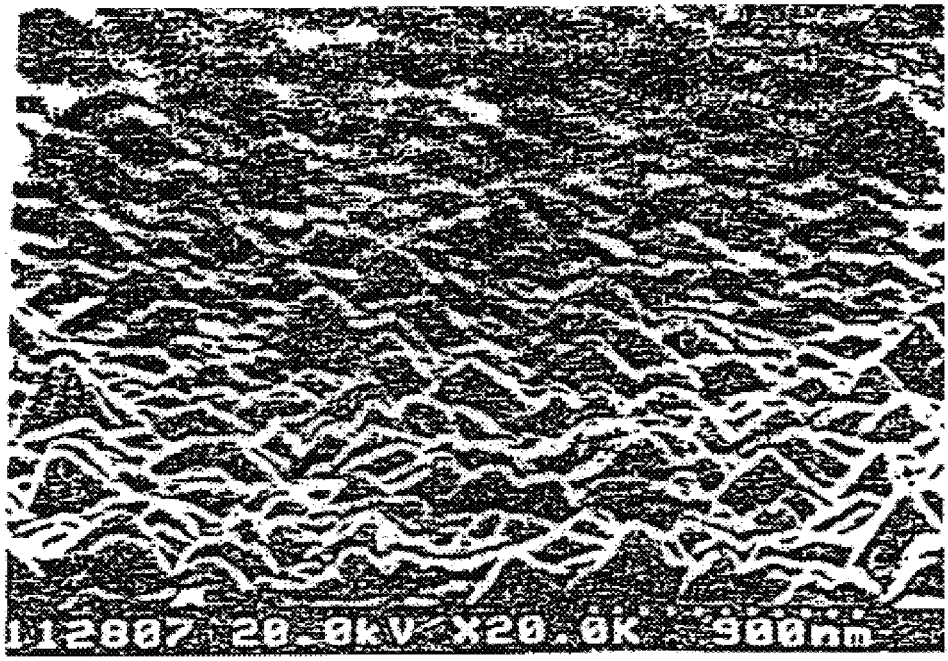
Figure 20:
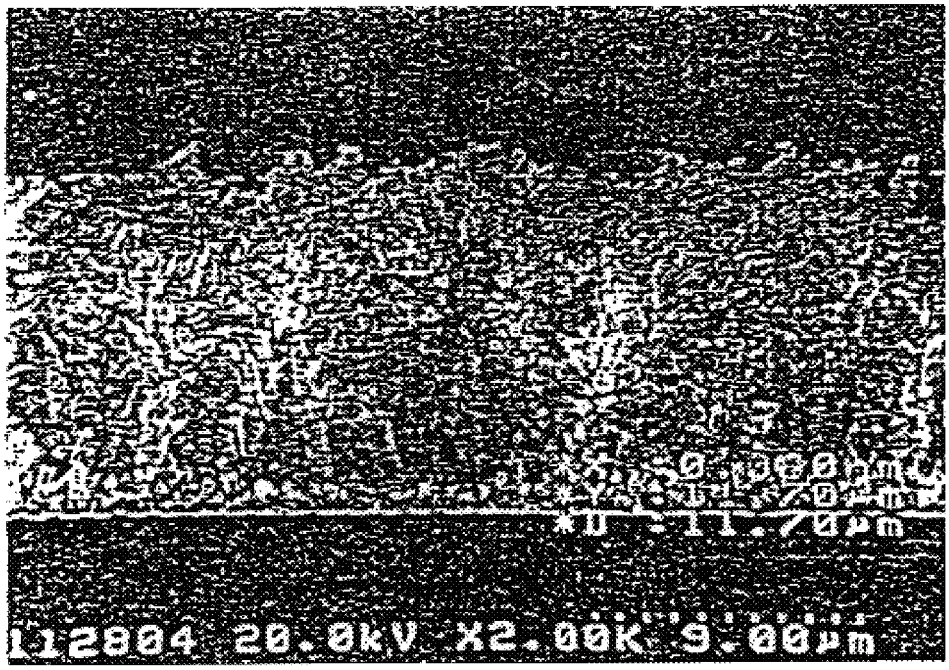
Figure 21:
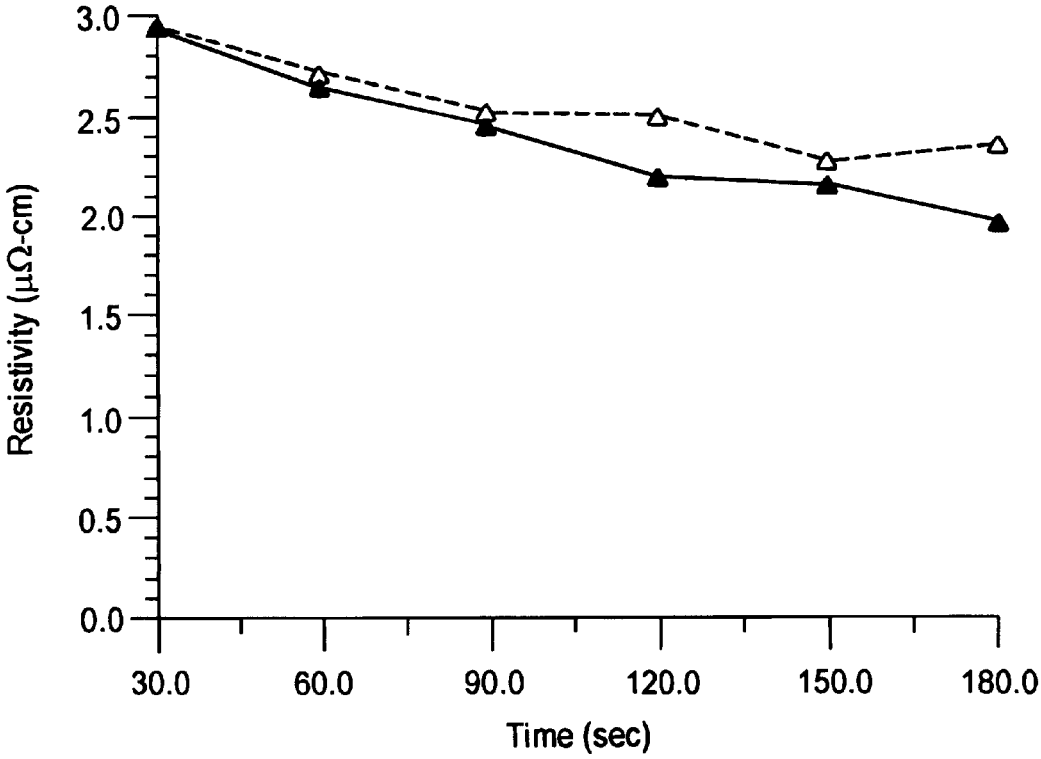

Various organic and inorganic additives are added in solution to help Cu electroplating. Thiourea is a common additive, which usually added in electroplating solution. As presented in FIG. 18, the resistivity of electroplated Cu films does not show big difference when the concentration of thiourea is smaller than 0.054 g/l. A high resistivity is observed when thiourea is more than 0.054 g/l. FIG. 19 presents the SEM image of Cu (111) at 0.03 g/l of thiourea addition. The current is applied at 2.4 A/dm$^2$. As shown from SEM image, addition of additives could help (111) formation at low current density, because the additive could be incorporated into the deposit to provide a specific growth orientation. FIG. 20 presents the SEM image of the electroplated Cu film at 0.054 g/l of thiourea addition. The current applied is still to keep at 2.4 A/dm$^2$. As shown in FIG. 20, when concentration of thiourea is increasing, the dendrite produced during Cu electroplating is increasing. This dendrite has similar geometric structure with diffusion-limited clusters. Moreover, thiourea could decompose to form pernicious product ($NH_4SCN$) which results in embattlement of electroplated Cu films. FIG. 21 shows the resistivity of copper film change with deposition time. It is appeared that resistivity is lower when the copper film become large block. Because that the grain boundary of copper film is decreasing to make surface more smooth than initial thin film. The resistivity of Cu film is higher when thiourea is added. According to SIMS results [FIGS. 22(*a*)(*b*)(*c*)], we can find the concentration of S element is increased with increasing concentration of thiourea. It is suggested that thiourea adsorbed on the surface of the cathode could make the resistivity of Cu increasing. In addition, voids is are formed when thiourea is used as additive agent.

PEG (polyethylene glycol) is widely used in Cu electroplating as a carrier agent. In this study, we use different molecular weight of PEG (200~10,000) and added in electrolyte with HCl and small amount of thiourea (0.0036 g/l), since small amount thiourea could help (111) plan formation. We can determine the larger molecular weight (m.w.>200) make the higher resistivity of copper film. According to FIG. 23, the resistivity of copper film is increasing with PEG molecular weight higher with deposition time. It is suggested that the longer chain length with thiourea is absorbed on the surface of the substrate. From SEM image shown in FIGS. 24(*a*)(*b*), film morphology doesn't change a lot when PEG molecular weight is increasing, but the plane (111) is decreasing when PEG molecular weight is increasing. [FIG. 25] According to SIMS analysis [shown in FIGS. 26(*a*)(*b*)], the major components of Cu film are still Cu, O, C, S and Ti. The amount of S element will be increasing with increasing molecular weight of PEG. This observation is proved by our suggestion which discussed previously.

Based on our results, a lot of thiourea and larger molecular weight of PEG (m.w>200) could not be used as additives in Cu electroplating for future Cu interconnect because of higher resistivity of copper film and poor cap-filling ability. In order to make Cu electroplating implemented in ULSI processing, a suitable additive must be developed. In this study, we try new traditional additive agents of molasses which shows the same effect on resistivity of copper film.

Glucose is also a common traditional additive agent used in Cu electroplating. In our experiment, we found the resistivity and orientation of electroplated copper film do not obviously change with different amount of glucose. However, filling capability in via and trench is poor. Although an equal thickness at all points of a feature is formed, a void still appears in the trench.

[C] The Effect of New Additive Agents

Figure 27:
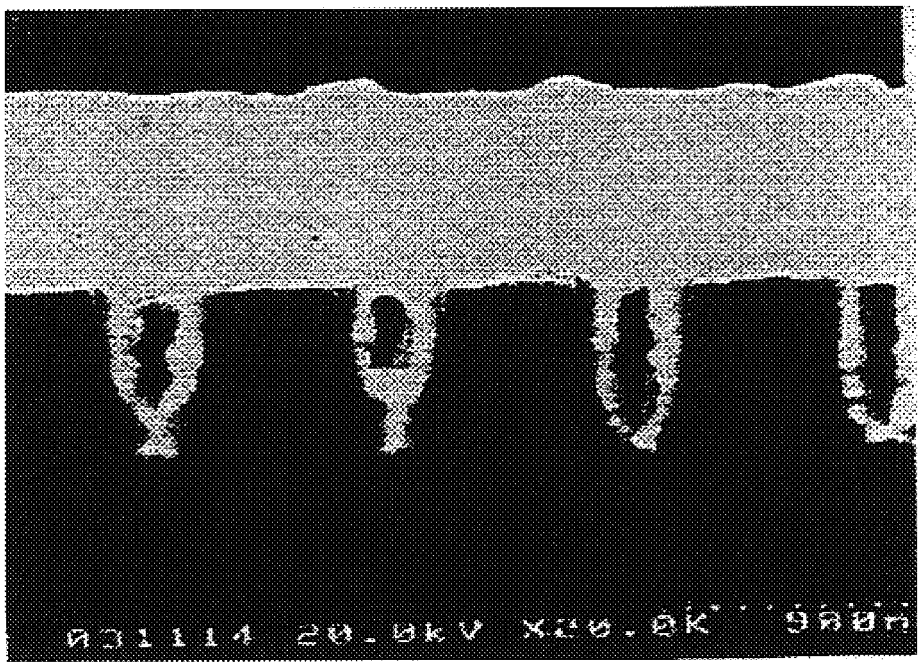
Figure 28:
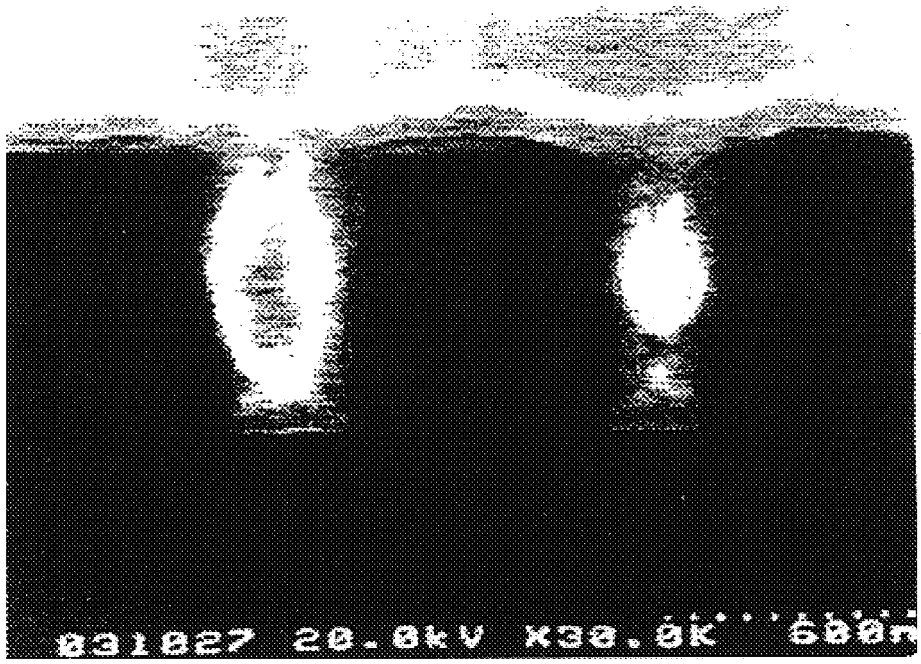

Sulfamates have been studied in interaction with a number of metals. They show little tendency to form complex in or affect the deposition by adsorption or bridging effects. Sulfamates could be used as a gap-filling promoter in Cu electroplating because it could decrease current efficient in Cu deposition. Since hydroxyl amine sulfate $(NH_2OH)_2.H_2SO_4$ has a similar functional group with sulfamate, it is postulated that it could be act as a good gap filling promoter. In order to examine if hydroxyl amine sulfate could act as a gap filling promoter, Cu electroplating with addition of hydroxyl amine sulfate is investigated in this experiment. The experiment is executed on the substrates with 0.3–0.8 $\mu$m width of trench/via. Since the thickness of base layer (seed layer and diffusion barrier) is 60 nm on the bottom and on the side wall and 120 nm on the top, the width less than 0.25 $\mu$m could be electrodeposited in the 0.35 $\mu$m width of trench. FIG. 27 reveals void is formed if no additive is added into the solution. The dimension of trench in FIG. 31 is measured to be 0.4 $\mu$m. Since Cu reduction is preferred to occur at the region of high current (at the top of trench), a void is easy to form. No void formation is observed when the additive of $(N_2OH)_2.H_2SO_4$ is added into the electroplating solution, as shown in. FIG. 28. The dimension of trench is measured to be 0.3 $\mu$m. A complete picture of SEM image in low magnification of Cu electroplated on 0.3–0.8 $\mu$m of trench/via is presented in FIG. 29. According to previous results, it is demonstrated that Cu could be electroplated into fine trenches or small sizes of vias when hydroxyl amine sulfate is used as a gap filling promoter. In addition, the resistivity of Cu film does not show significant change. [see FIG. 30] The concentration of O in the Cu film measured to be very low [FIG. 31]. Therefore, oxidation of Cu or seed layer could be neglected. According to SIMS analysis, it is found that the concentration of impurity (S element) is very low in copper film [FIG. 32]. A further study of this new additive is still investigated in progress.

Since hydroxyl amine sulfate ($(NH_2OH)_2.H_2SO_4$) has both amino and sulfate functional group, it is proposed to use as a gap filling promoter in helping Cu electroplating. Another additive agent, hydroxyl amine hydrochloride $(NH_2OH).HCl$, could be considered to use for Cu electroplating because it has a similar amine functional group with chloride. In our experiment, we use different amount of hydroxyl amine hydrochloride $(NH_2OH).HCl$ as a gap filling promoter. The ability of filling is not really good. Some trenches can be completely filled by Cu but others can not. However, the lower resistivity of copper film could be decreased to 1.9 $\mu\Omega\cdot$cm when small or hydroxyl amine hydrochloride is used in the electrolyte compared to the Cu film with no additive added. [FIG. 30]

Other organic additives with unsaturated $\pi$ bonds, like tribenzylamine, benzotriazole and naphthalene sulfonic acid, could be considered to be used as additives in Cu electroplating. Since they have unsaturated $\pi$ bonds, the $\pi$ electrons could interact with surface atoms of copper, to produce substantial effect on the properties of deposits. Brightness, leveling, as well as stability effect is still needed to do further study. This study, we try to use tribenzylamine and benzotriazole as leveling agents. However, these levels agents are quite difficult in soluble in sulfate acid solution to make experiment unworkable.

(VIII) Conclusions

A strong Cu (111) peak was observed at higher electrical current applied. The development of growth orientation of the copper film could be rationalized by considering surface energy and stain energy at different crystal planes. In the initial stage, the orientation of Cu (002) plane was existed because this plane possessed the lowest surface energy. As applied electrical current was increased the stain energy becomes a dominant factor in governing grain growth. A strong peak of Cu (111) was appeared when applied electrical current was increasing. In addition, additives played an important role in controlling the orientation of electroplated Cu films at low current density. No void formation was observed when Cu electrodeposited onto a 0.3 μm width of trench in the presence of ($(NH_2OH)_2.H_2SO_4$) additive. The concentration of O in the sample was measured to be rather low. Therefore, oxidation of Cu or seed layer could be neglected. In summary, sulfamate group showed little tendency to form complex ions, therefore, it could stabilize Cu (I) and reduce current efficiency for copper deposition. Since hydroxyl amine sulfate ($(NH_2OH)_2.H_2SO_4$) had both amino and sulfate functional groups, which were similar to sulfamate, it was postulated that hydroxyl amine sulfate could be used as a gap filling promoter in helping Cu electroplating.

TABLE I

Chemical composition of the electroplated Cu solution

| Composition | Concentration |
|---|---|
| CuSO4 5H2O | 60–150 g/l |
| H2SO4 | 80–150 g/l |
| Cl ions | 50–150 ppm |
| PEG | ~100 ppm |
| Addition agents | Small |

Table Captions

Table 1. Chemical composition of the electroplated Cu solution

Figure Captions

FIG. 1. Typical deposition profile in plating.

Figure 2:
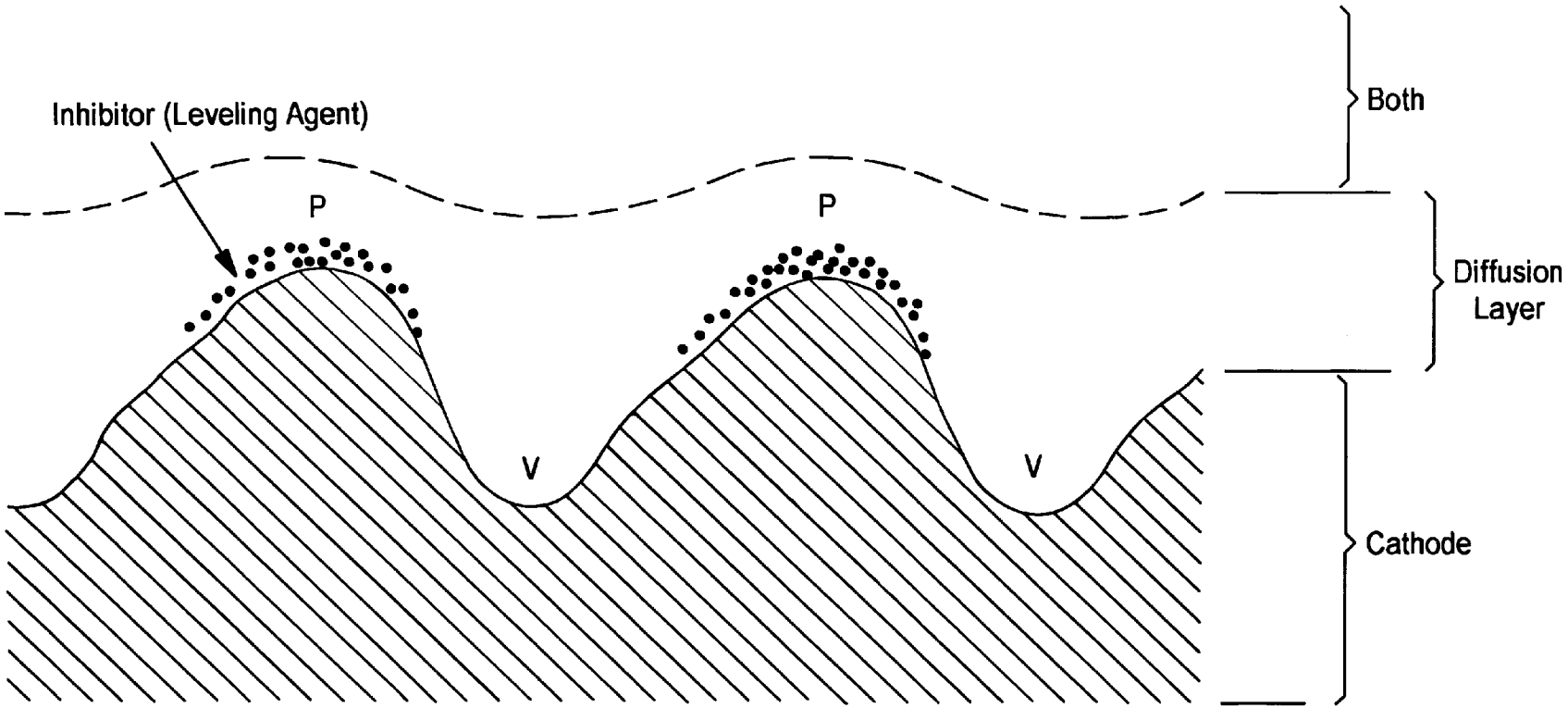

FIG. 2. Schematic cross-section shows micro-roughness at cathode. The leveling is accumulated at peak (P) because diffusion is relatively fast at the short distance from the diffusion boundary. Diffusion at valley (V) is too slow to keep up with consumption of leveling agent. Consequently, metal deposition is inhibited at peak but not in the valleys, and filling in the valleys produces a smoother surface.

FIG. 3.(*a*) Copper electroplated into a 0.4 micron trench with aspect ratio =2.1:1

FIG. 3.(*b*) Copper electroplated into a 0.35 micron trench with aspect ratio =2.4:1

Figure 4:
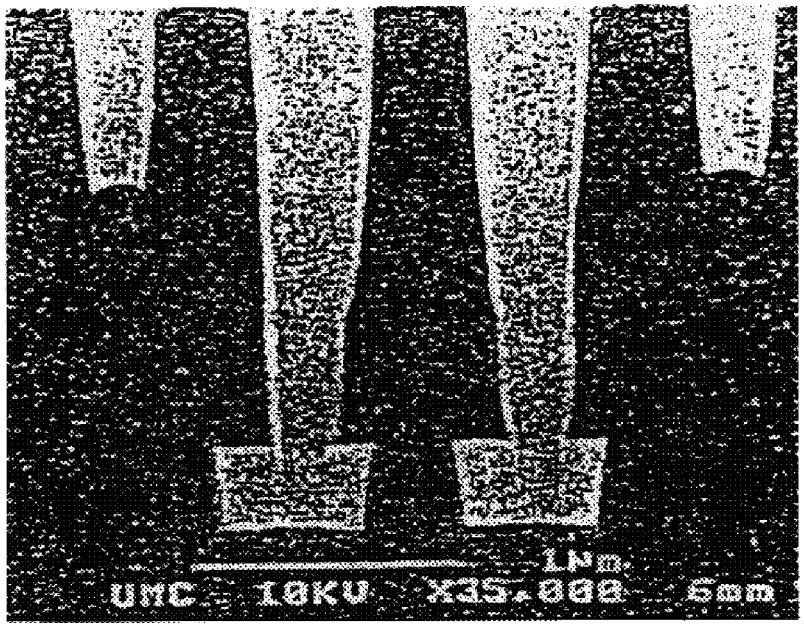
Figure 4:
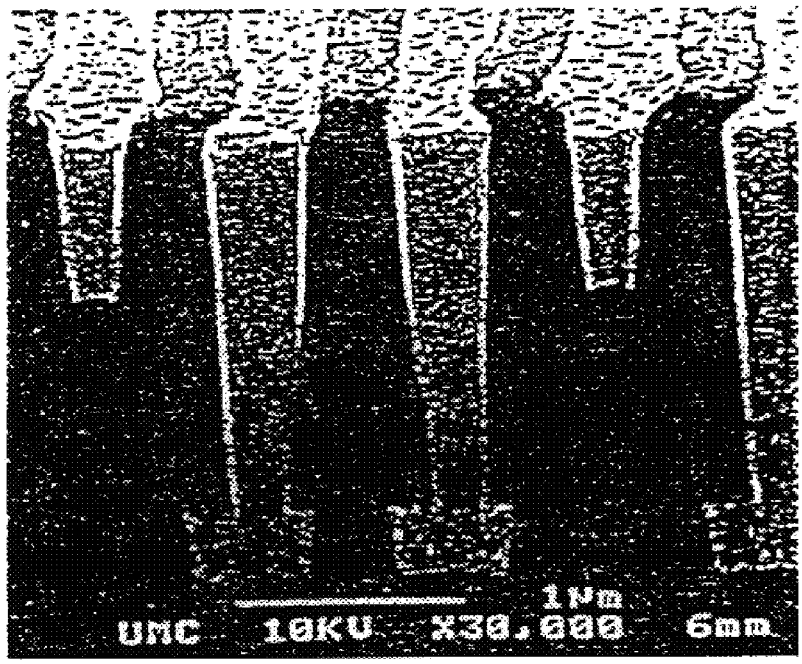

FIG. 4. The optimized deposition process is able to fill a high aspect-ratio (~5) feature hole of a 0.28 μm via size without obvious seam formation.

FIG. 5. Schematic of the Cu electroplating system.

FIG. 6. Dependence of the thickness vs. $H_2SO_4$ concentration change. ($CuSO_4.5H_2O$ at 90 g/l, current density at 2.4 A/dm$^2$ and time at 2 min)

FIG. 7. Cu films resistivity change as a function of concentration of $H_2SO_4$ ($CuSO_4.5H_2O$ at 90 g/l, $H_2SO_4$ at 90 g/l, current density at 2.4 A/dm$^2$ at 2 min).

Figure 8A:
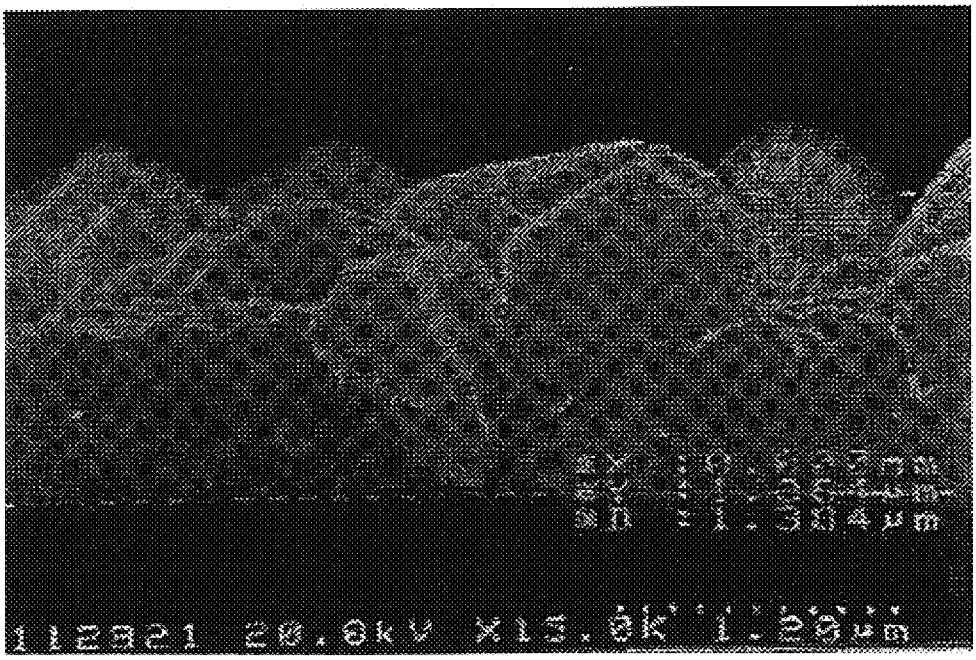
Figure 8B:
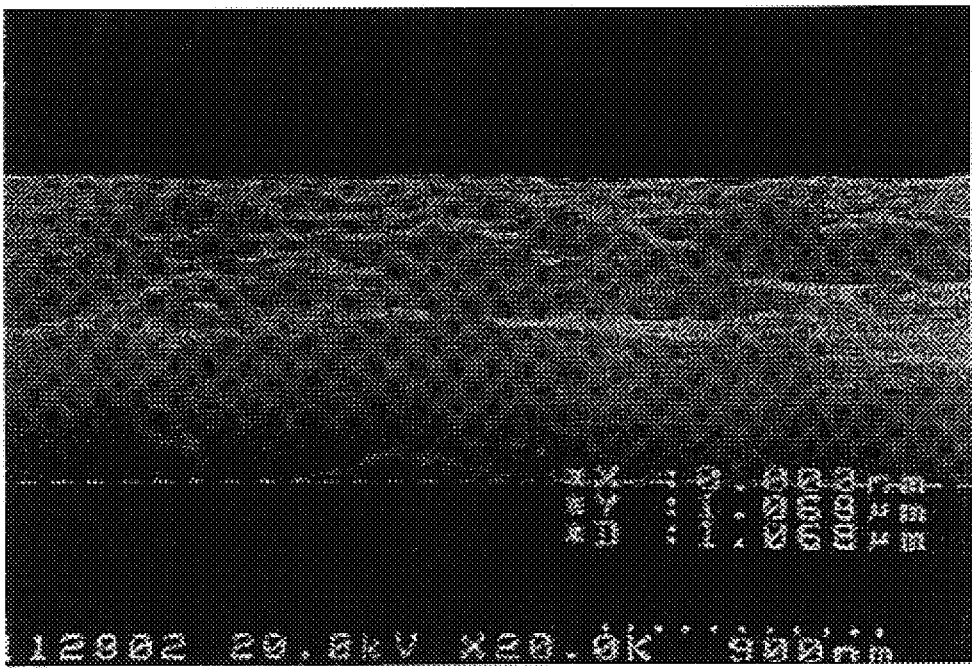

FIGS. 8*a* and 8*b* SEM images of copper film morphology with an without $H_2SO_4$ presence. (a) only $CuSO_4.5H_2O$ (90 g/l) (b) $CuSO_4.5H_2O$ (90 g/l) & $H_2SO_4$ (20 ml/l)

FIG. 9. Dependence of film deposition rate vs. current density variation. ($CuSO_4.5H_2O$ at 90 g/l, $H_2SO_4$ at 197 g/l and time at 2 min)

FIG. 10. Film resistivity change as a function of applied current variation. ($CuSO_4.5H_2O$ at 90 g/l, $H_2SO_4$ at 197 g/l and time at 2 min)

Figure 11A:
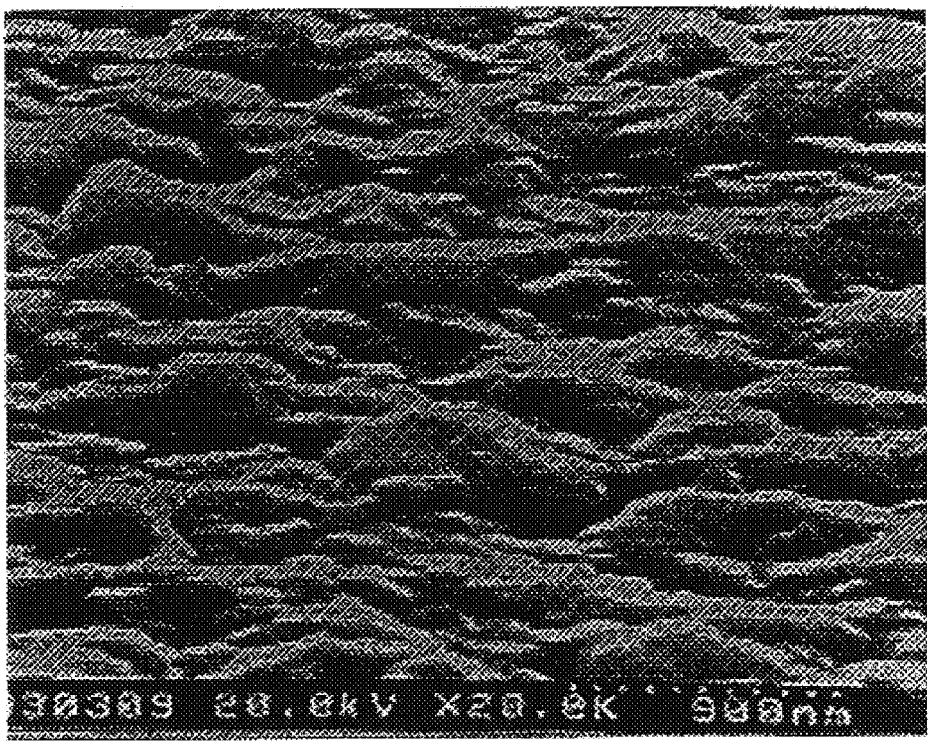
Figure 11B:
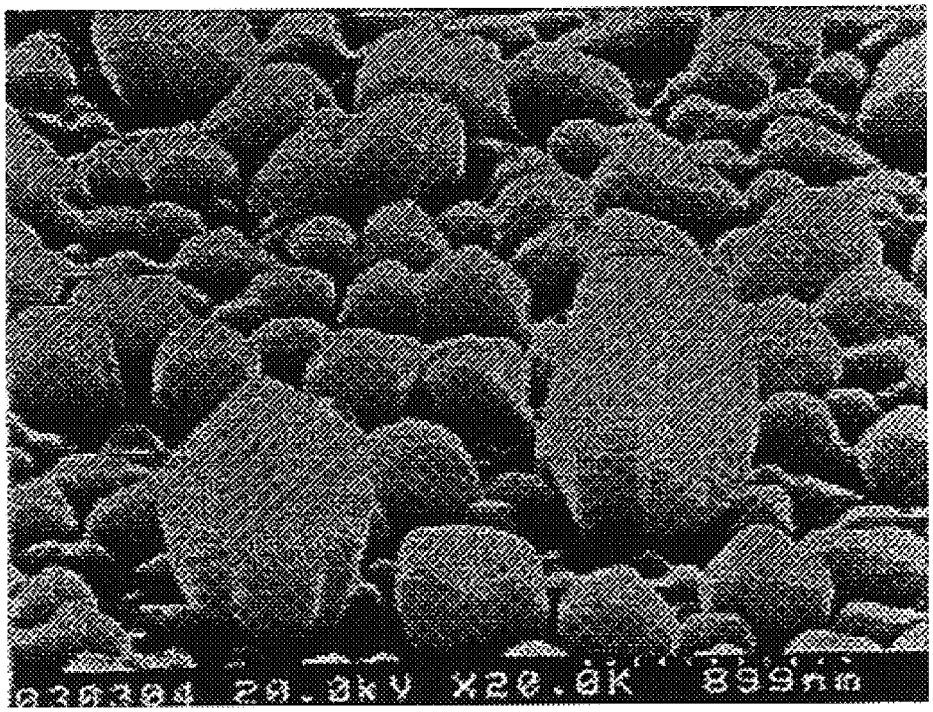

FIGS. 11*a* and 11*b* Cu film morphology at different applied currents.

FIG. 12. XRD measurement at various applied currents. ($CuSO_4.5H_2O$ at 90 g/l, $H_2SO_4$ at 197 g/l and time at 2 min)

Figure 13B:
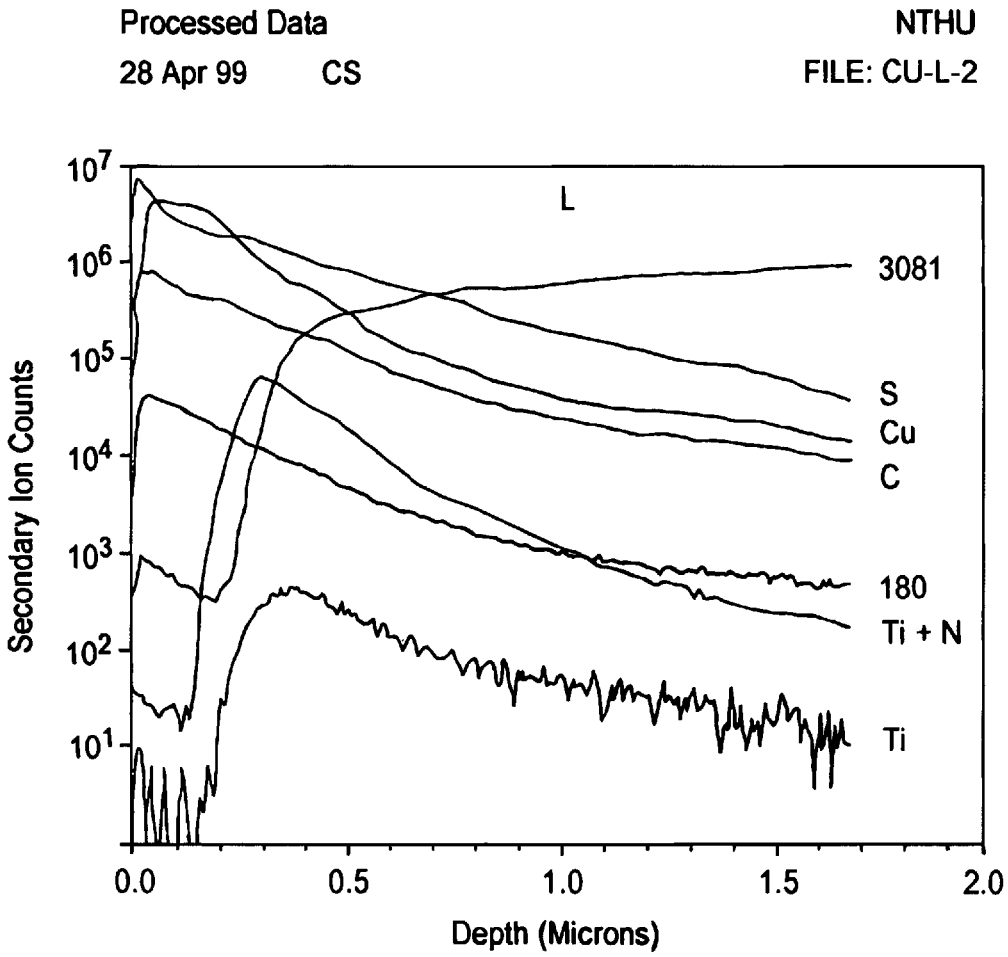

FIG. 13.(*a*) The SIMS results showed that oxygen concentration in electroplated Cu film at low applied current density of 1.2 A/dm$^2$.

FIG. 13.(*b*) The SIMS results showed that oxygen concentration in electroplated Cu film at high applied current density of 3.2 A/dm$^2$.

FIG. 14 Showed the images of pattern wafer before electroplating

Figure 15:
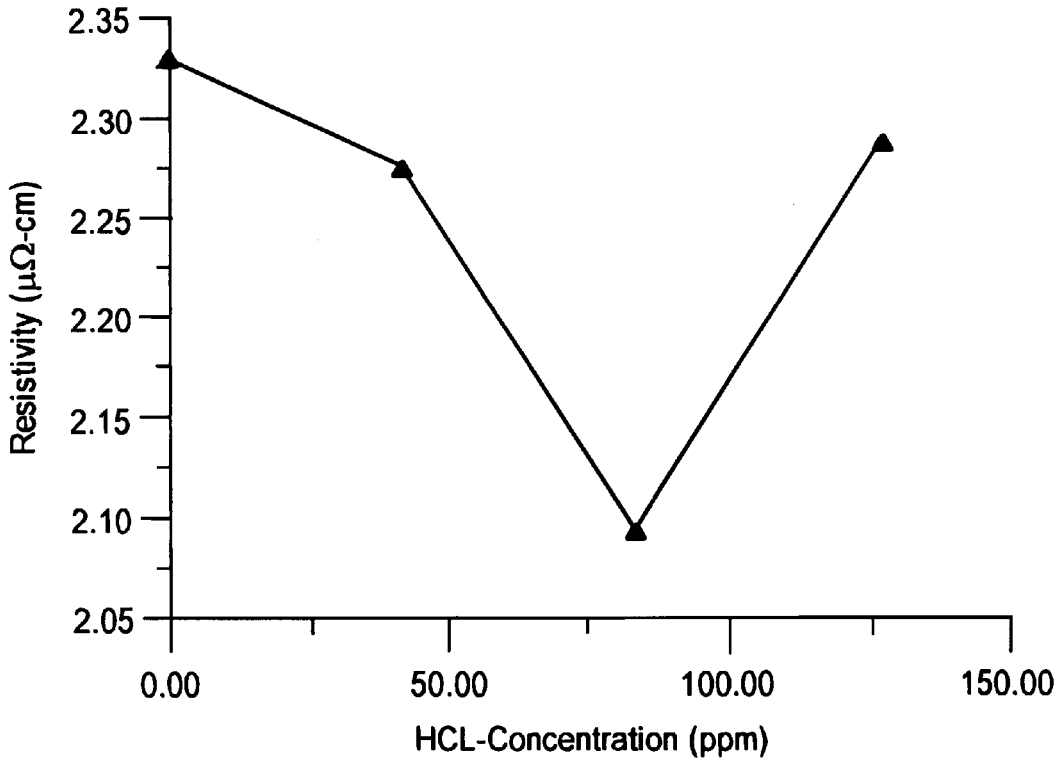

FIG. 15 The relationship of Cu film resistivity vs. various concentration of HCl ($CuSO_4.5H_2O$ at 90 g/l, $H_2SO_4$ at 197 g/l, current density at 2.4 A/dm$^2$ at 2 min).

Figure 16A:
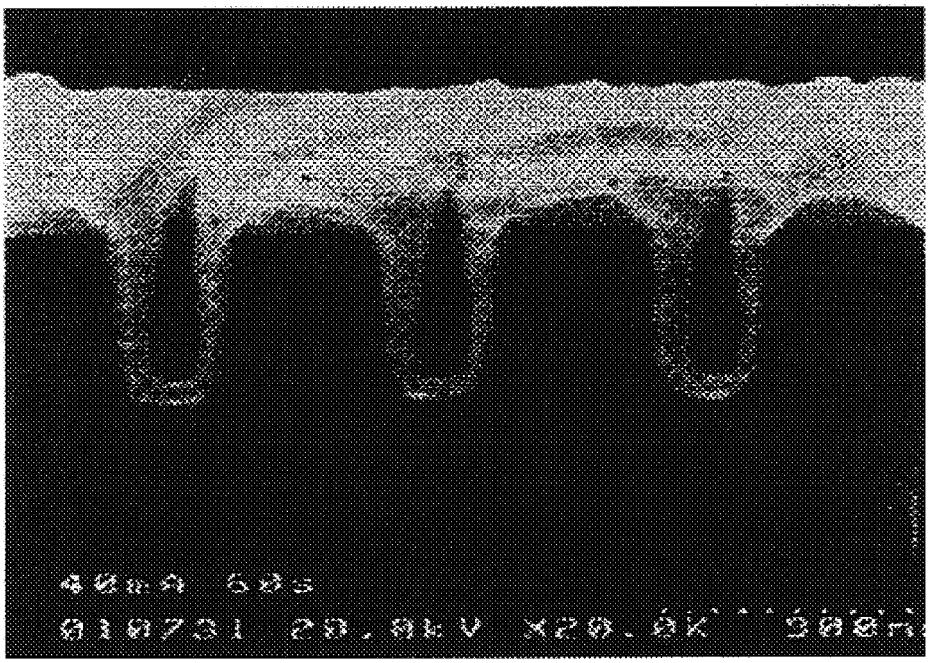
Figure 16B:
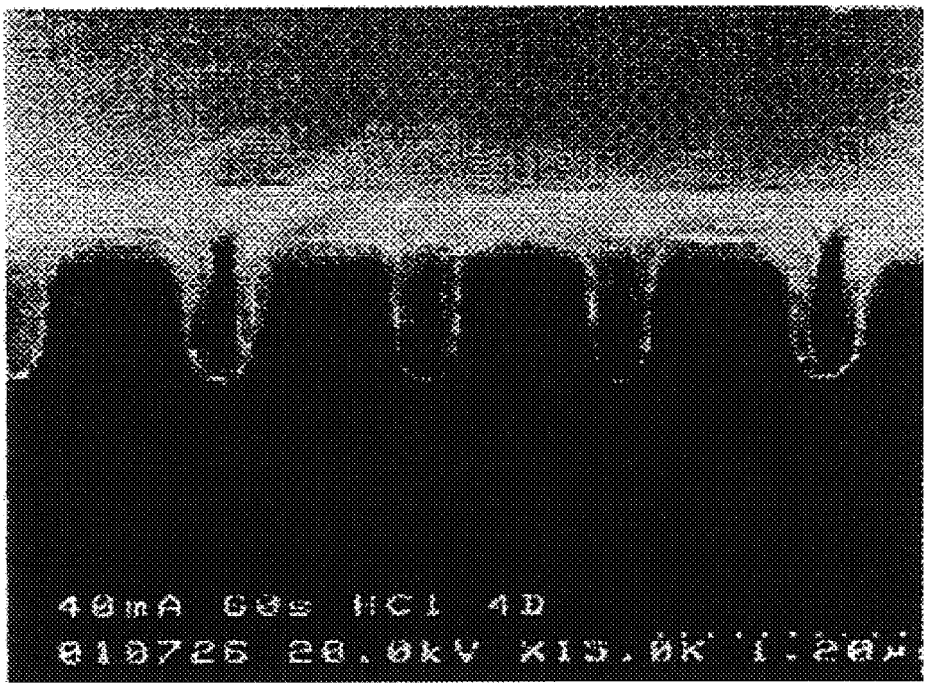
Figure 17:
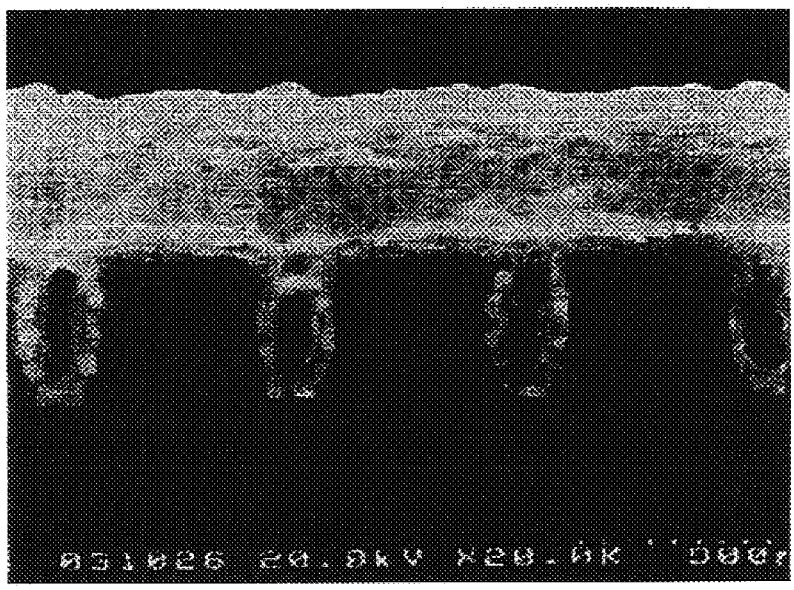
Figure 17:
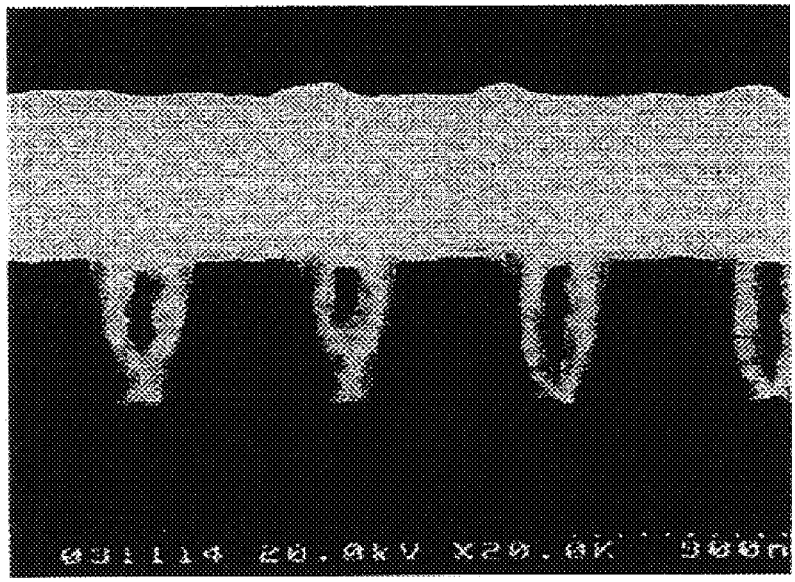

FIGS. 16*a* and 16*b* The uniformity at the top of the trench is (a) not smooth without HCl addition (b) more smooth with HCl addition.

Figure 18:
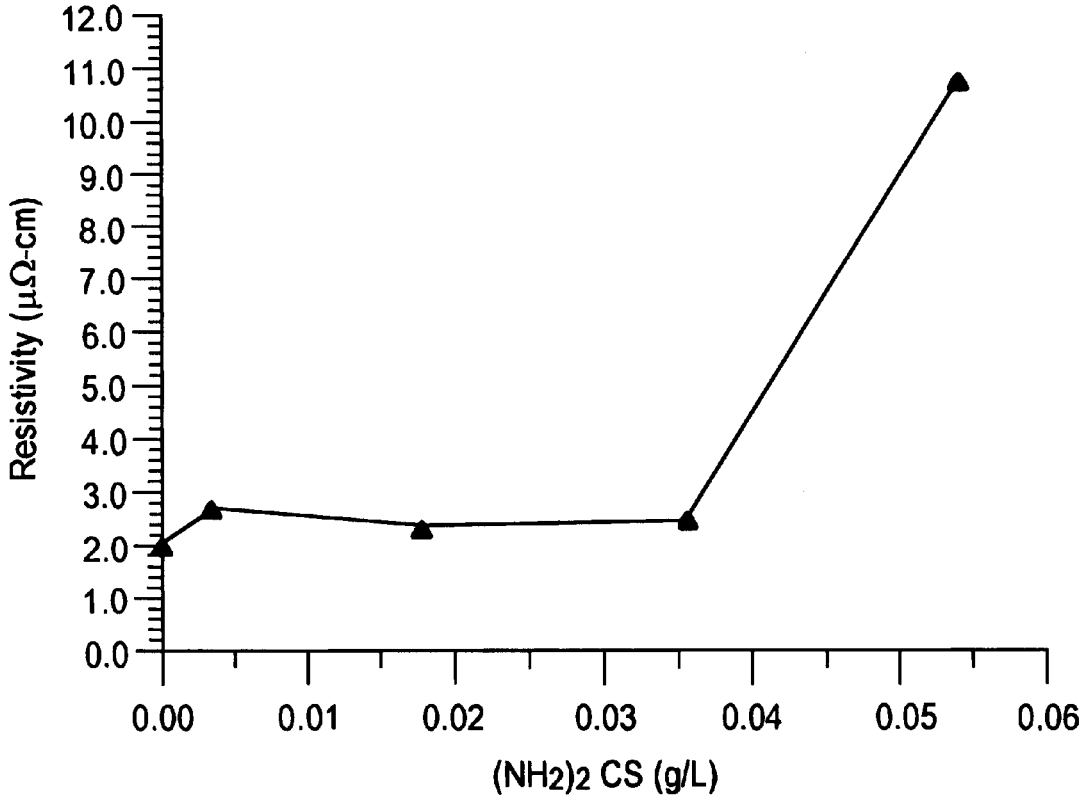

FIG. 17 Voids are obviously formed in the trench without any additive agent addition FIG. 18 The relationship of Cu film resistivity vs. various concentration of $(NH)_2CS$. ($CuSO_4.C^5H_2O$ at 90 g/l, $H_2SO_4$ at 197 g/l, HCl at 70 ppm, current density at 2.4 A/dm$^2$ at 2 min).

FIG. 19 SEM image of the electroplated Cu film at 0.03 g/l of thiourea addition, applied current density is 2.4 A/dm$^2$.

FIG. 20 SEM image of the electroplated Cu film at 0.054 g/l of thiourea addition, applied current density was 2.4 A/dm$^2$.

FIG. 21 The relationship of Cu film resistivity vs. deposition time (($CuSO_4C_5H_2O$ at 90 g/l, $H_2SO_4$ at 197 g/l, HCl at 70 ppm current density at 1.2 A/dm$^2$).

Figure 22A:
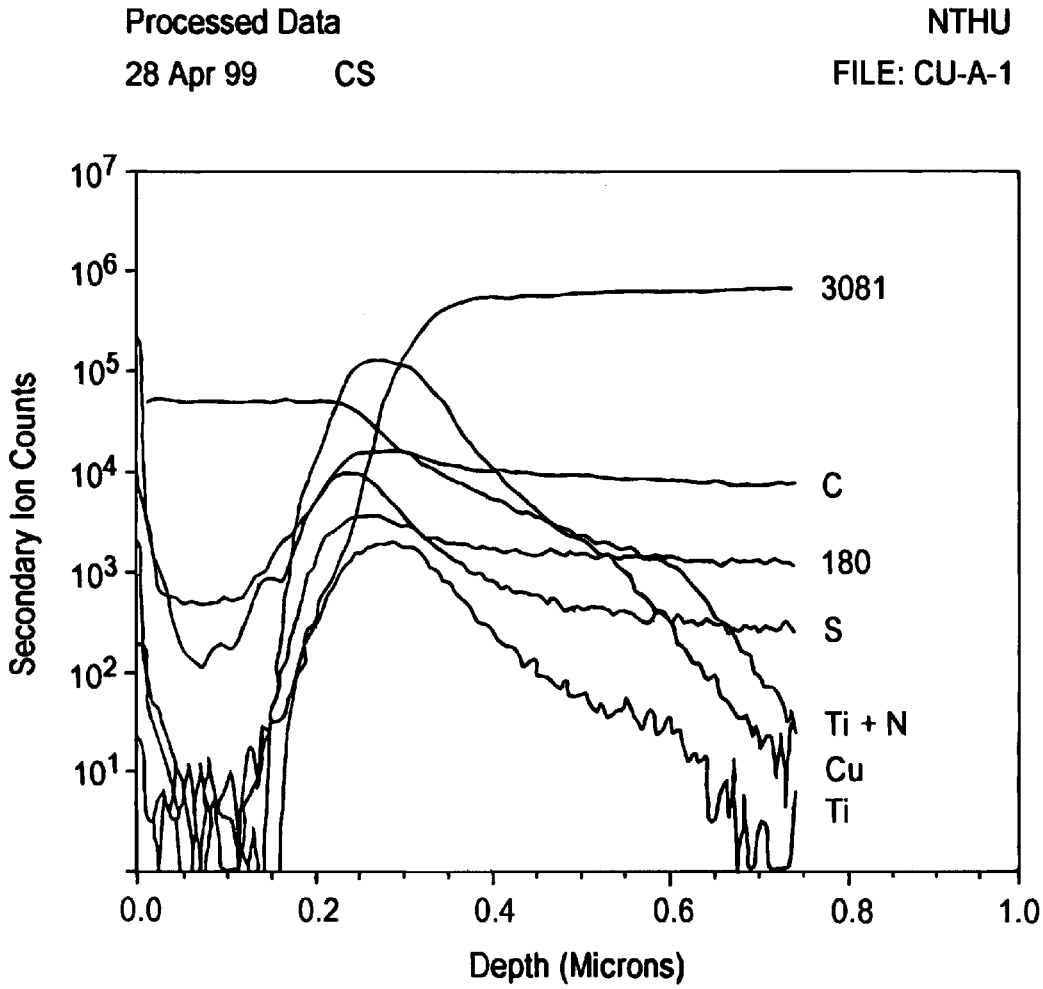
Figure 22B:
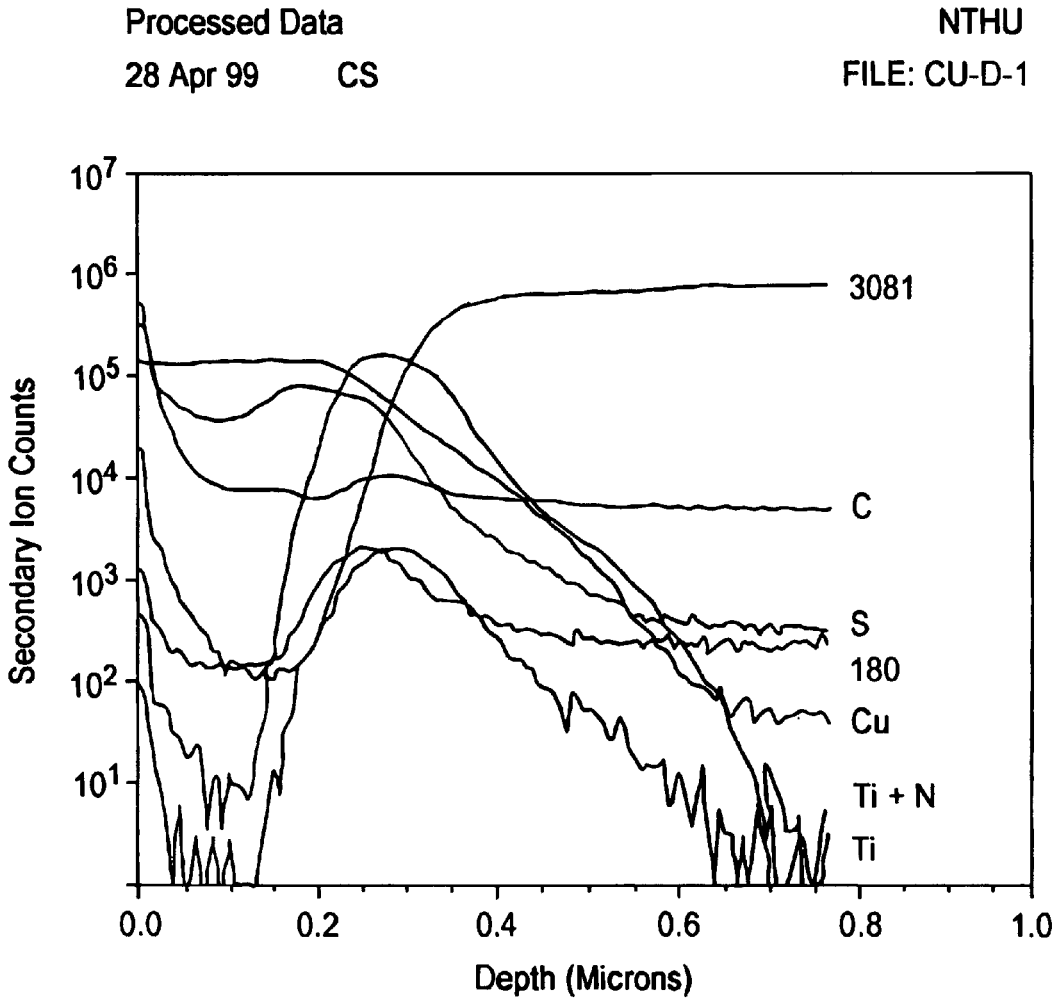
Figure 22C:
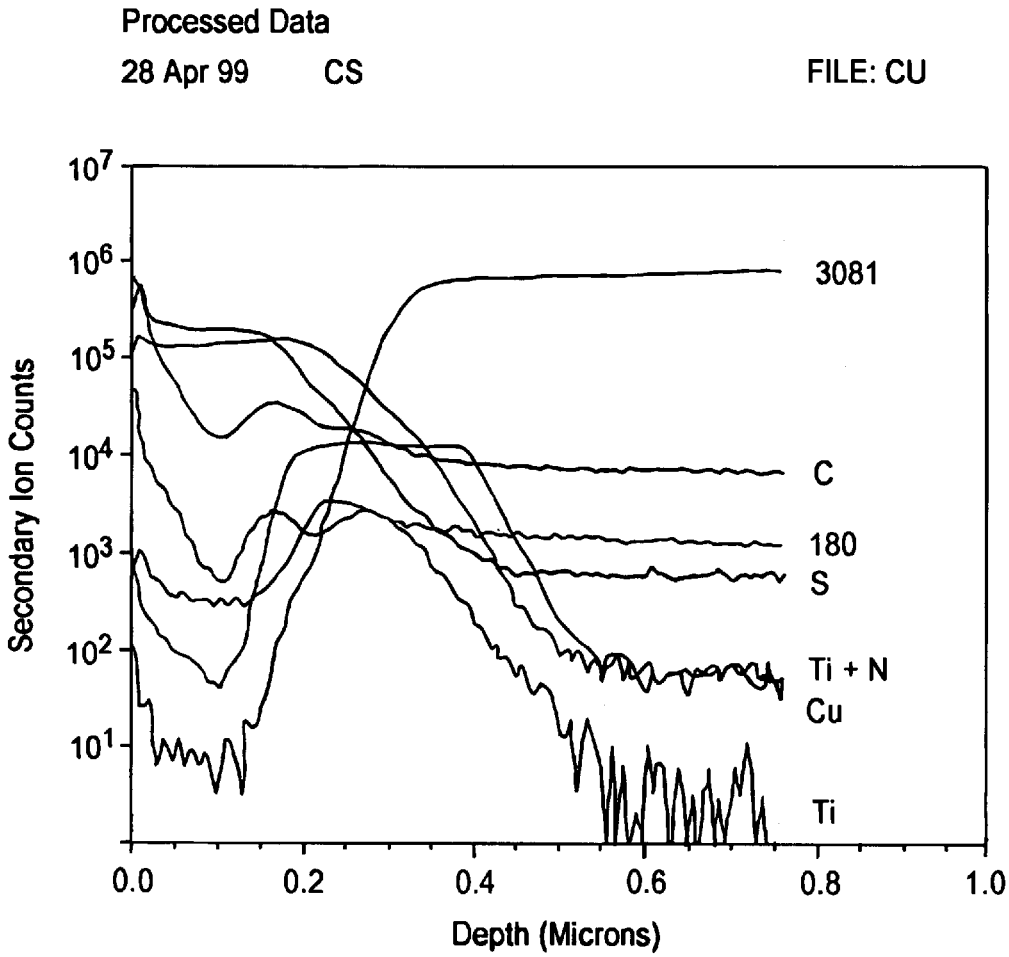

FIG. 22(*a*) SIMS analysis on Cu film without thioura presence

FIG. 22(*b*) SIMS analysis on Cu film with thioura 0.0036 g/l addition

FIG. 22. (c) SIMS analysis on Cu film with thioura 0.018 g/l addition.

Figure 23:
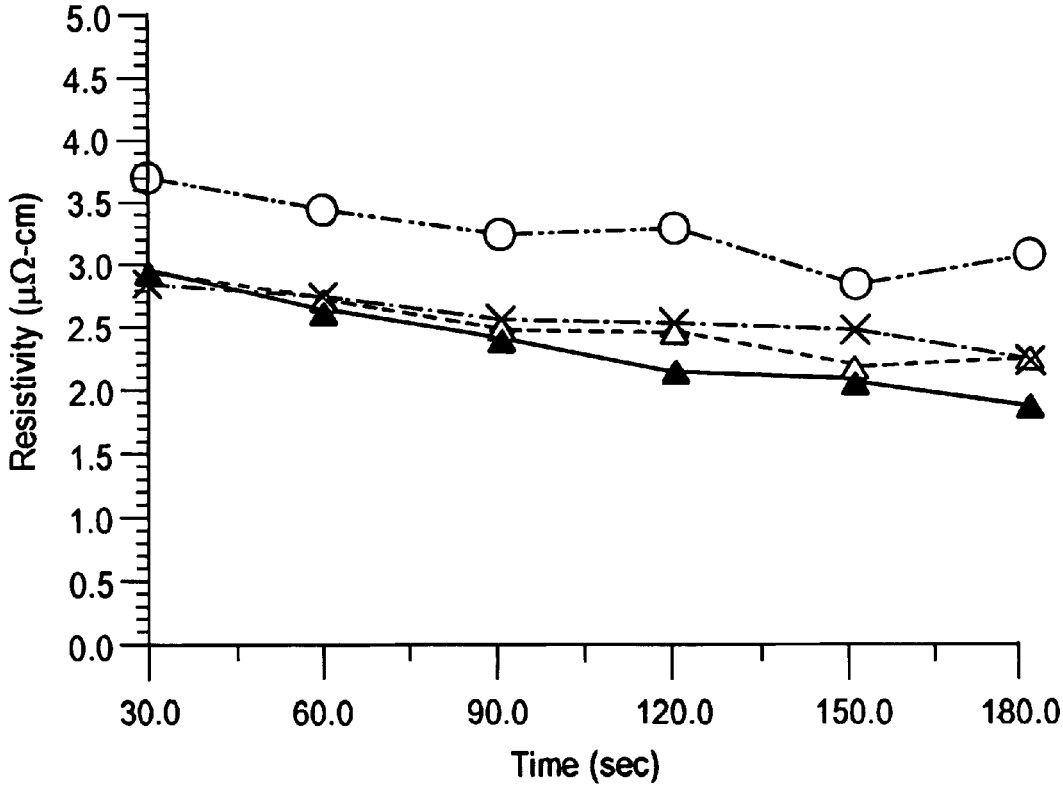

FIG. 23 The resistivity of Cu films change with various PEG molecular weight at different deposition time. ($CuSO_4.5H_2O$ at 90 g/l, $H_2SO_4$ at 197 g/l, HCl at 70 ppm, current density at 1.2 A/dm$^2$.

Figure 24A:
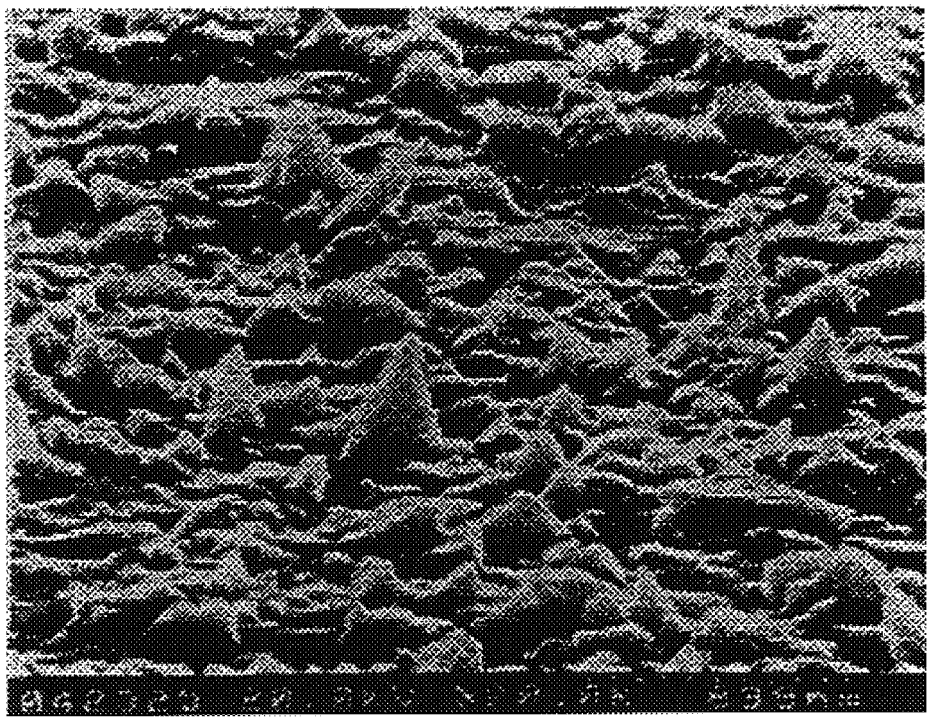
Figure 24B:
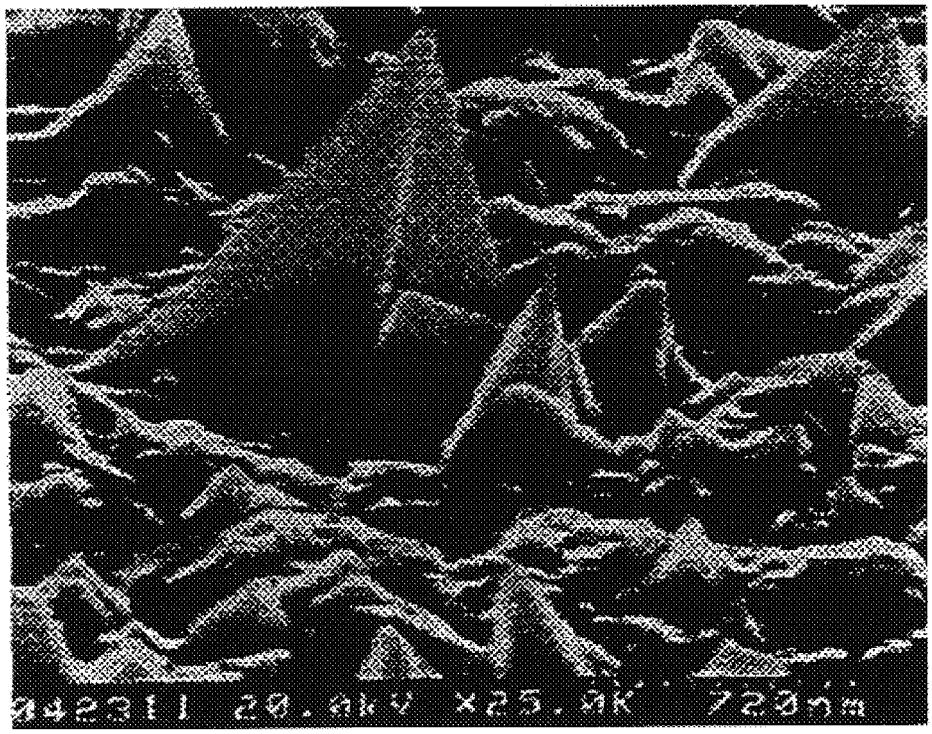

FIG. 24 Film morphology analysis with different amount of thiourea.

Figure 25:
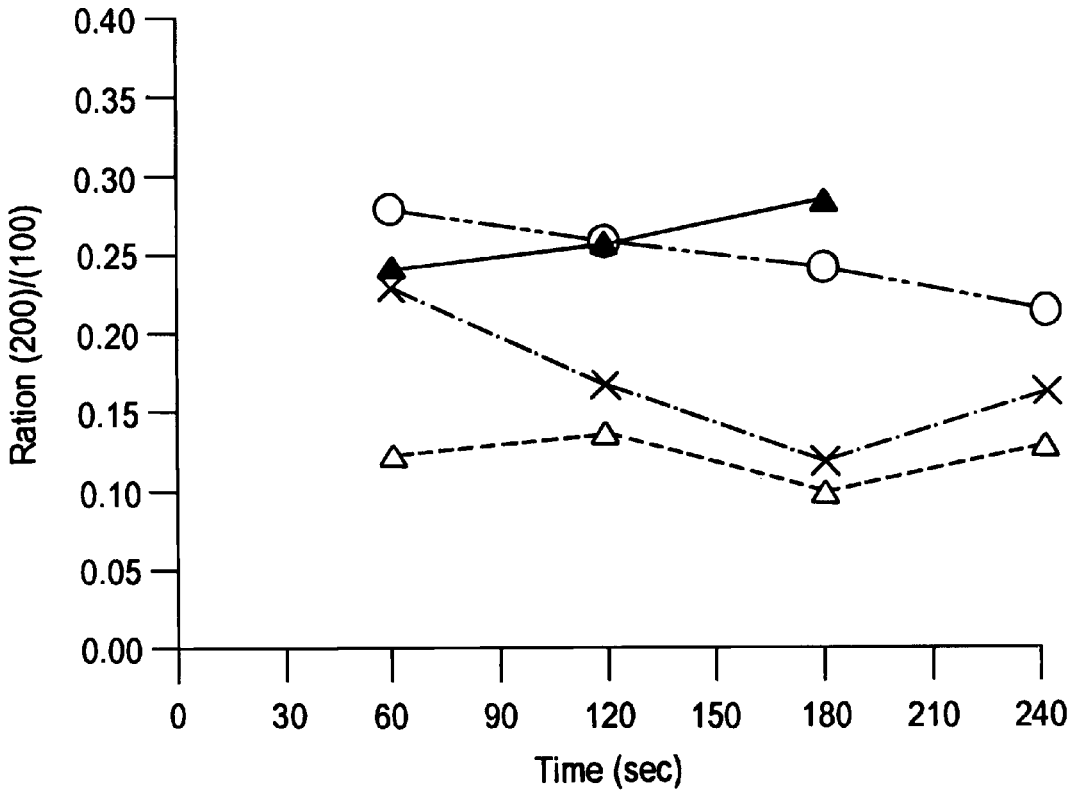

FIG. 25 XRD measurement at various PEG molecular weight.

Figure 26A:
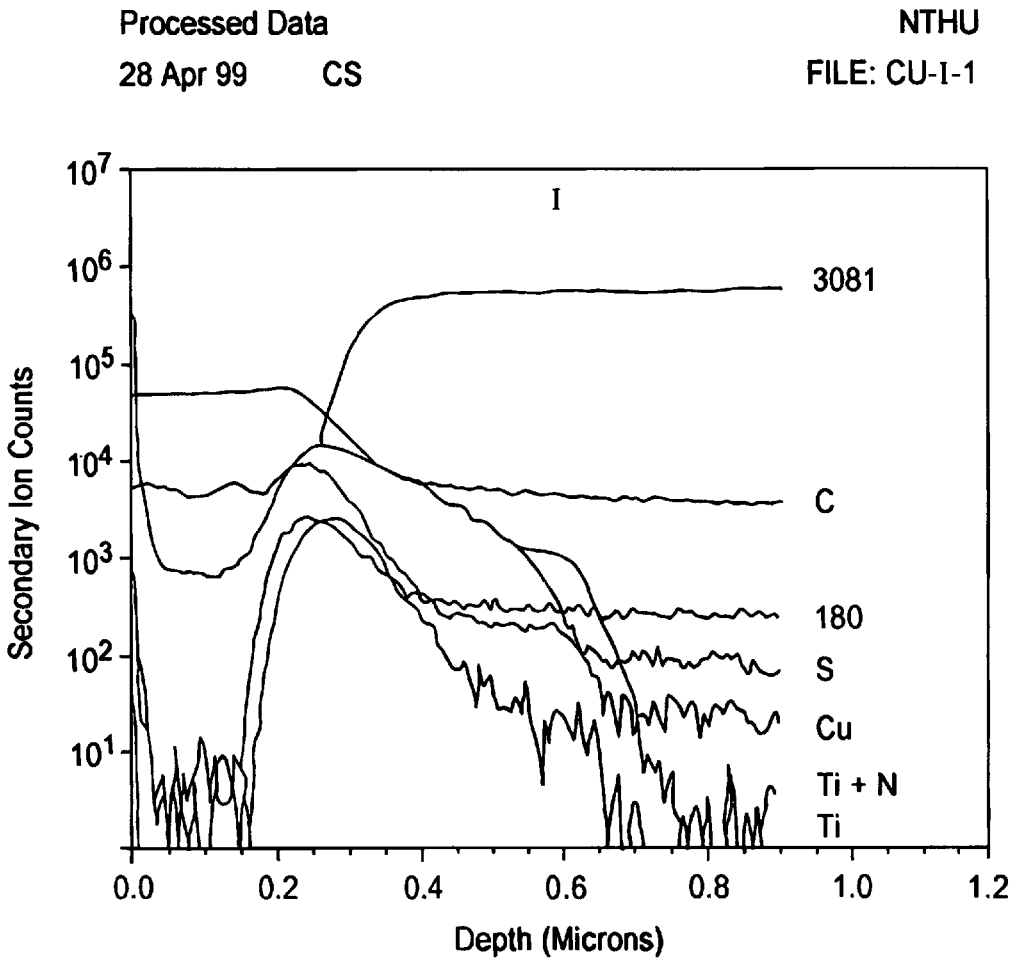
Figure 26B:
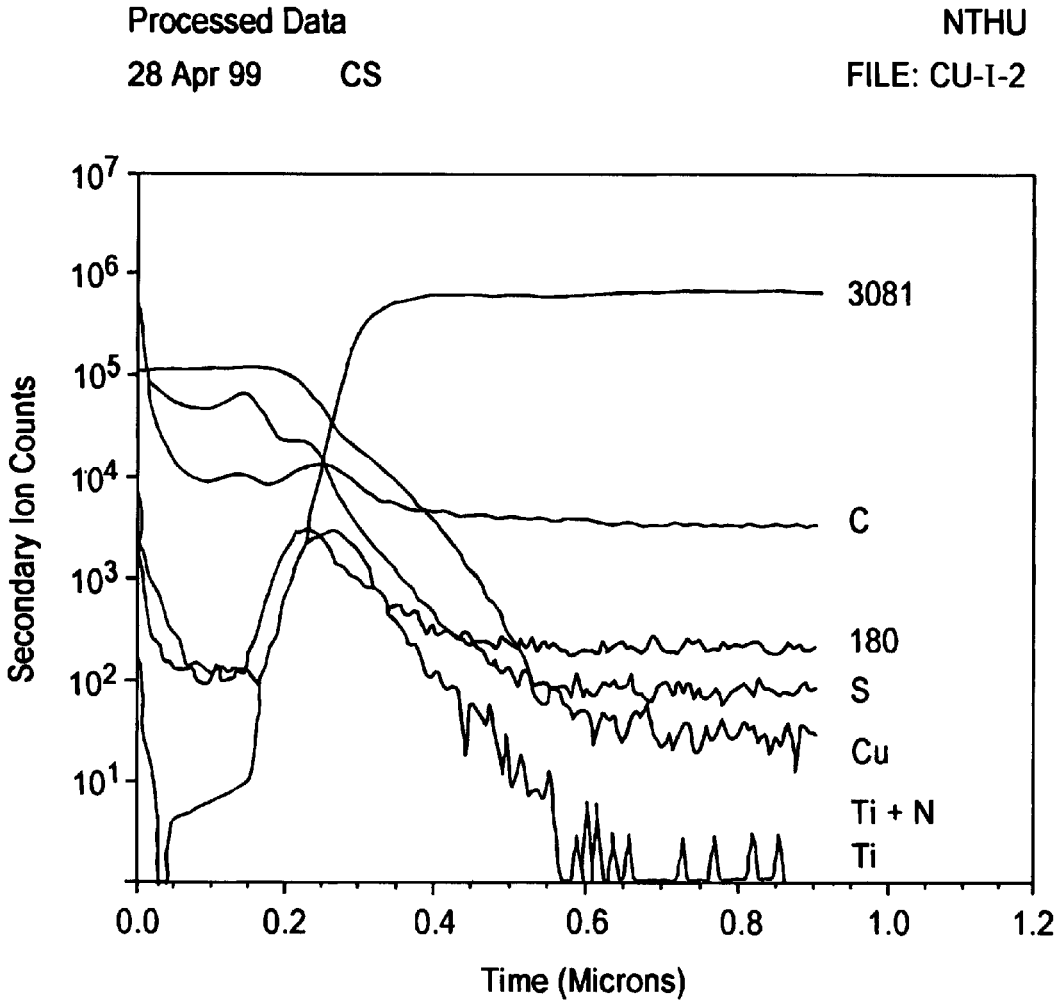

FIG. 26(*a*) The SIMS analysis on Cu film with thiourea and PEG200 addition.

FIG. 26(*b*) The SIMS analysis on Cu film with thiourea and PEG4000 addition.

FIG. 27. The SEM image of the electroplated Cu film without additive agent addition. The dimension of trench is 0.25 μm.

FIG. 28. The SEM image of the electroplated Cu film at 0.06 g/l of $(NO_2OH)H_2SO_4$ addition. The dimension of trench is 0.25 μm.

Figure 29A:
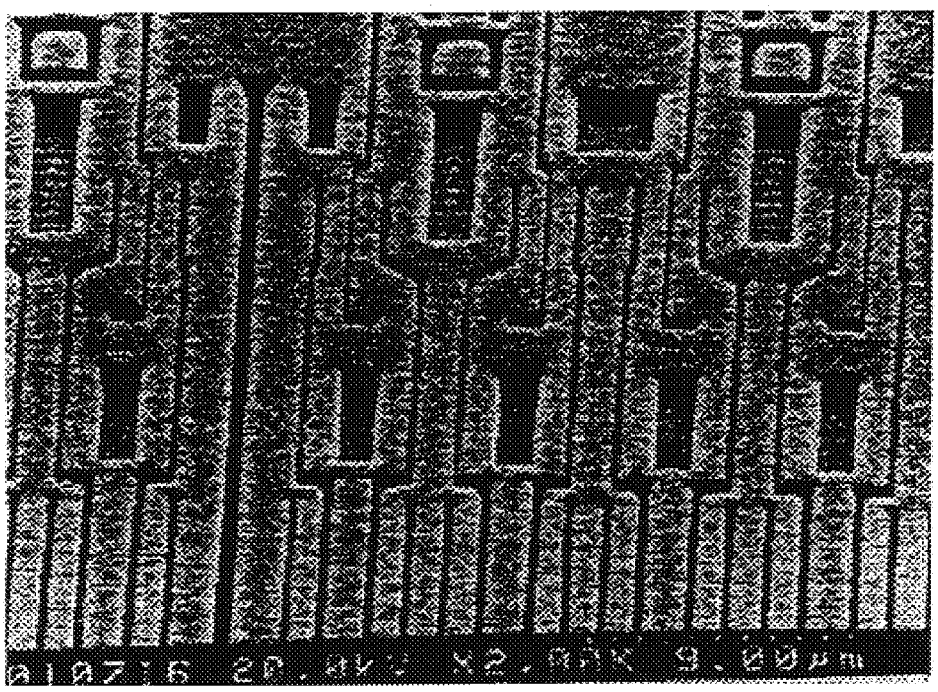
Figure 29B:
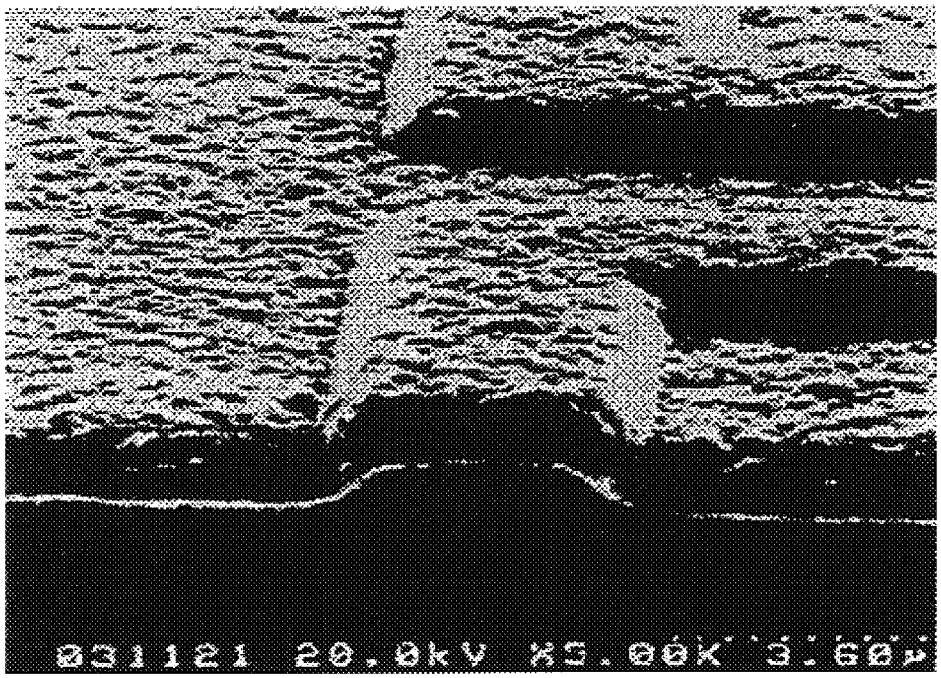

FIG. 29.(*a*) & (*b*) A low magnification of the SEM image of Cu Electroplate on 0.3~0.8 μm of trench/via.

Figure 30:
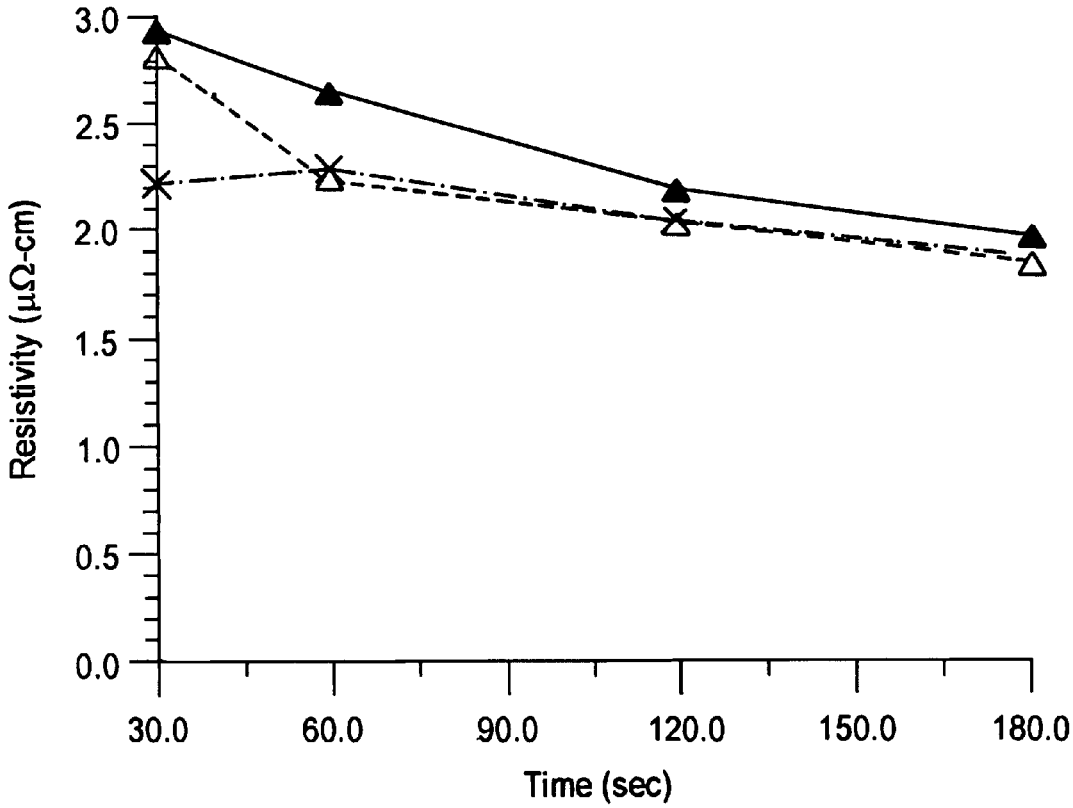
Figure 31:
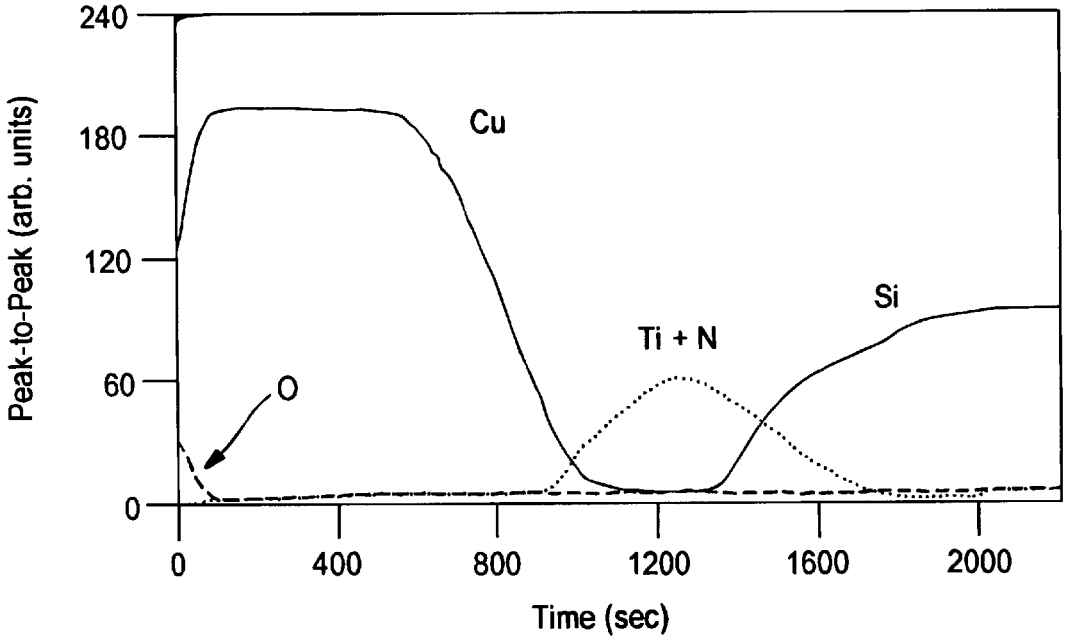

FIG. 30. The resistivity change with different amount of additive additive agent at different deposition time.

FIG. 31. The AES analysis of the Cu film at 0.06 g/l of $(NH_2OH)_2H_2SO_4$ addition.

Figure 32:
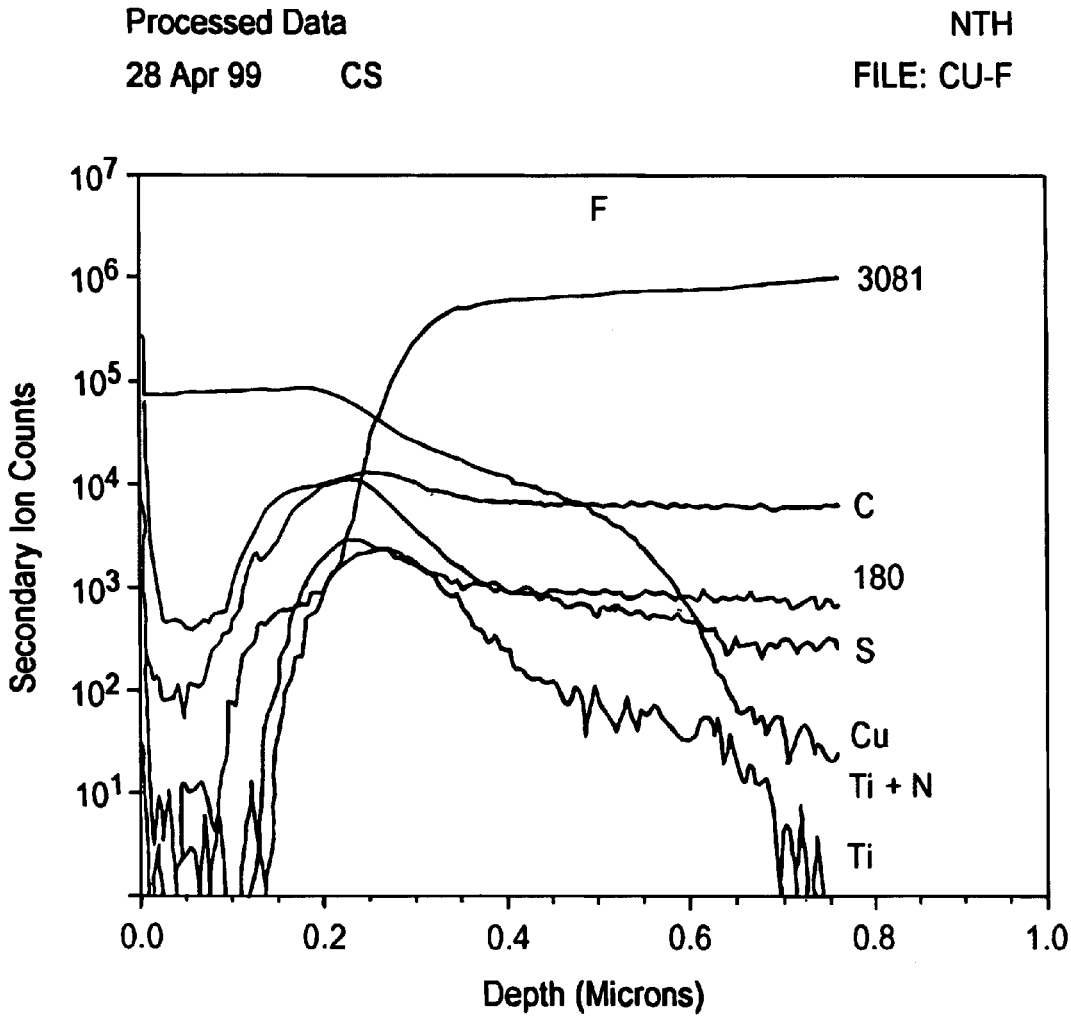

FIG. 32. The SIMS analysis on Cu film at 0.06 g/l of $(NO_2OH)_2H_2SO_4$ addition.

What is claimed is:

1. An electroplating solution for copper comprising $CuSO_4.5H_2O$, $H_2SO_4$, HCl, polyethylene glycol with a molecular weight greater than 200, hydroxyl amine sulfate, and hydroxyl amine chloride.

2. An electroplating solution according to claim 1 further comprising $Cl^-$ ions in a range of 50–150 ppm and wherein the hydroxyl amine sulfate is in a range of 0.01–5 g/l.

3. An electroplating solution according to claim 1 further comprising $Cl^-$ ions derived at least from the HCl in a range of 55–125 ppm.

4. An electroplating solution according to claim 1, further comprising an additive.

5. An electroplating solution according to claim 4, wherein the additive is thiourea, molasses, glucose, tribenzylamine, benzotriazole, or naphthalene sulfonic acid.

6. An electroplating solution comprising adding together:

$CuSO_4.5H_2O$;

$H_2SO_4$;

HCl;

optionally an additive; and polyethylene glycol with a molecular weight greater than 200, and either hydroxyl amine sulfate or hydroxyl amine chloride.

7. An electroplating solution comprising:

$CuSO_4.5H_2O$;

$H_2SO_4$;

$Cl^-$ ions;

polyethylene glycol with a molecular weight greater than 200; and hydroxyl amine sulfate or hydroxyl amine chloride.

8. An electroplating solution according to claim 7, wherein the concentration of $CuSO_4.5H_2O$ is 60–150 g/l, $H_2SO_4$ is 80–150 g/l, $Cl^-$ ions are 50–150 ppm, and polyethylene glycol is less than 100 ppm.

* * * * *